US007806233B2

(12) United States Patent
Parker

(10) Patent No.: US 7,806,233 B2
(45) Date of Patent: Oct. 5, 2010

(54) ACCESS LADDER AND METHOD

(75) Inventor: Thomas W. Parker, Jamestown, PA (US)

(73) Assignee: Werner Co., Greenville, PA (US)

( * ) Notice: Subject to any disclaimer, the term of this patent is extended or adjusted under 35 U.S.C. 154(b) by 623 days.

(21) Appl. No.: 11/009,895

(22) Filed: Dec. 9, 2004

(65) Prior Publication Data

US 2006/0124398 A1 Jun. 15, 2006

(51) Int. Cl.
*E06C 5/00* (2006.01)

(52) U.S. Cl. ..... 182/207; 182/77

(58) Field of Classification Search ..... 182/207–213, 182/77

See application file for complete search history.

(56) References Cited

U.S. PATENT DOCUMENTS

| | | | | | |
|---|---|---|---|---|---|
| 28,039 | A * | 4/1860 | Kavemann | ..... | 182/168 |
| 248,014 | A * | 10/1881 | Boardman | ..... | 182/120 |
| 349,370 | A * | 9/1886 | Springer | ..... | 182/212 |
| 408,281 | A * | 8/1889 | Wright | ..... | 182/208 |
| 463,868 | A * | 11/1891 | Norman | ..... | 182/167 |
| 720,891 | A * | 2/1903 | Chamberlain et al. | ..... | 182/156 |
| 856,875 | A * | 6/1907 | Hughes | ..... | 182/210 |
| 2,736,482 | A * | 2/1956 | Borden et al. | ..... | 182/78 |
| 3,171,671 | A * | 3/1965 | Cornett | ..... | 280/163 |
| 4,757,876 | A * | 7/1988 | Peacock | ..... | 182/95 |
| 4,926,964 | A * | 5/1990 | Herrin | ..... | 182/22 |
| 5,174,411 | A * | 12/1992 | Oliver et al. | ..... | 182/77 |
| 5,758,745 | A * | 6/1998 | Beggs et al. | ..... | 182/207 |
| 6,581,876 | B2 * | 6/2003 | Cheung | ..... | 244/118.5 |
| 6,840,526 | B2 * | 1/2005 | Anderson et al. | ..... | 280/166 |
| 2004/0160035 | A1 * | 8/2004 | Stodola et al. | ..... | 280/163 |

* cited by examiner

*Primary Examiner*—Alvin C Chin-Shue
(74) *Attorney, Agent, or Firm*—Ansel M. Schwartz

(57) ABSTRACT

An access ladder for an access hole in a building includes a plurality of sections which telescope relative to each other between an extended position, where the sections define a plane and a user can climb the sections, and a retracted position where the sections are folded on each other. Several of the sections have a least one step which preferably moves between an unfolded position where the user can stand on the step when the sections are in the extended position, and a folded position when the sections are in the retracted position. Each section slides relative to another section of the plurality of sections which it is in contact in order for the sections to telescope. A method for using an access ladder attached to an end of an access hole of a building.

7 Claims, 22 Drawing Sheets

DETAIL A
SCALE 1 : 2

DETAIL A
SCALE 1 : 2

DETAIL A
SCALE 1 : 2

DETAIL B
SCALE 1 : 2

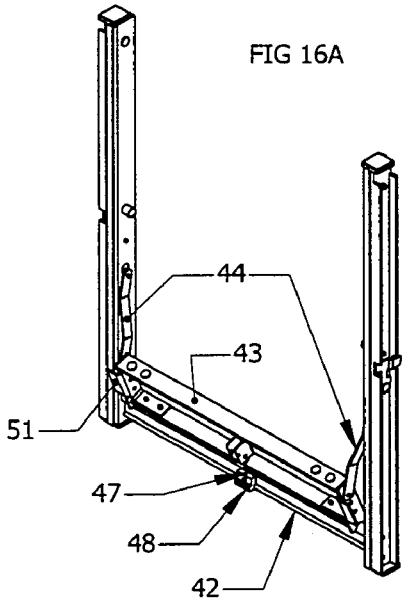
FIG 16A
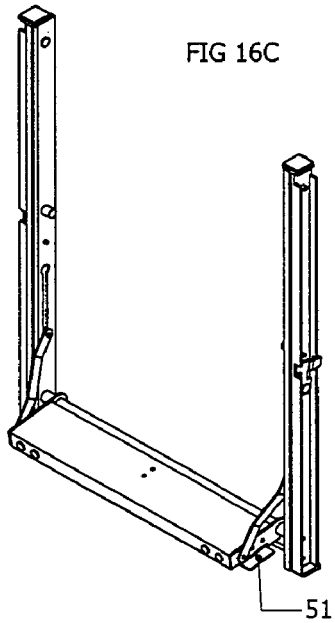
FIG 16C
FIG 16E
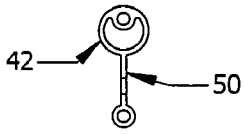
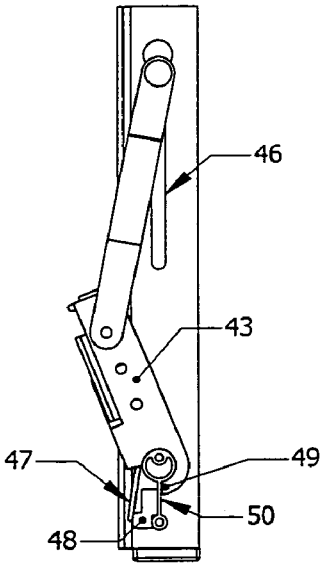
FIG 16B
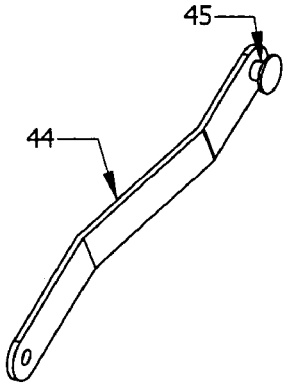
FIG 16F
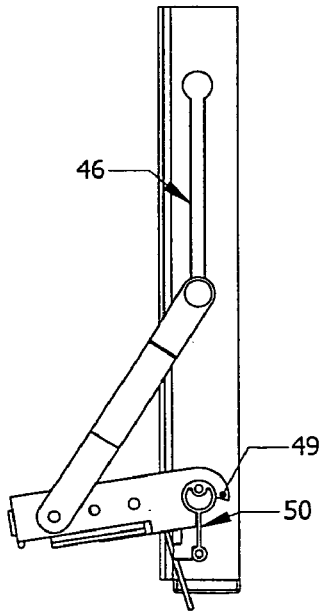
FIG 16D

DETAIL A
SCALE 1 : 4

DETAIL B
SCALE 1 : 4

DETAIL C
SCALE 1 : 4

FIG 20a
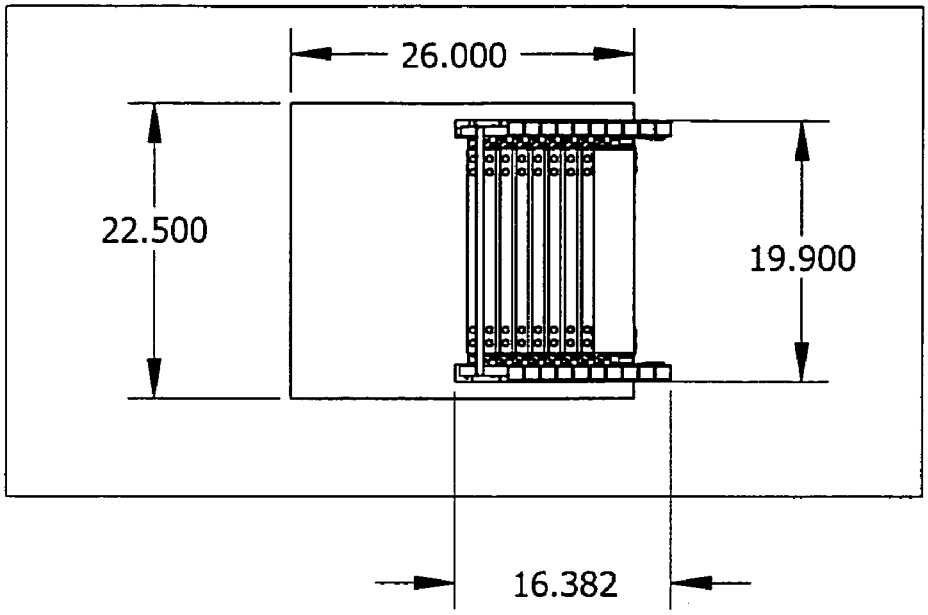
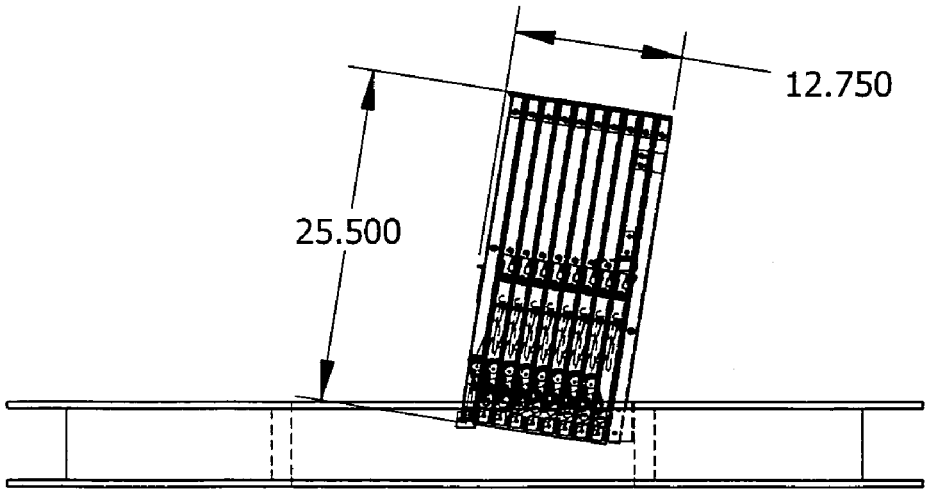
FIG 20 b

ACCESS LADDER AND METHOD

FIELD OF THE INVENTION

The present invention pertains to an access ladder having sections which telescope between a retracted position and an unfolded position. More specifically, the present invention pertains to an access ladder having sections which telescope between a retracted position and an unfolded position, where at least some of the sections have a step stop attached to each side rail of the section which contacts and unfolds a folding step attached to the section immediately behind it as the section moves into the extended position.

BACKGROUND OF THE INVENTION

Many houses today, whether new construction or older, have access holes in the ceiling in order to provide entry into the areas under the roof or into crawlspaces above the ceiling. These rectangular access holes are commonly located in hallways or in closets and are typically small, sometimes as small as 22 inches by 26 inches. It is standard practice for a person desiring to get into the area above the access hole to use a ladder. If this ladder is long enough to reach up through the access hole, then it is likely too long to store in the house unless lying horizontally. If stored elsewhere, such as in a garage, the ladder is difficult to maneuver through the house. In any case, climbing up through the access hole is not convenient. Because of this inconvenience, potential storage space above the access hole remains unused.

The primary purpose of this invention is to provide an extendable easy-to-use ladder which is conveniently mounted in the access hole.

SUMMARY OF THE INVENTION

The present invention pertains to an access ladder for an access hole in a building. The ladder comprises a plurality of sections which telescope relative to each other between an extended position, where the sections define a plane and a user can climb the sections, and a retracted position where the sections are folded on each other. Several of the sections have a least one step which preferably moves between an unfolded position where the user can stand on the step when the sections are in the extended position, and a folded position when the sections are in the retracted position. Each section slides relative to another section of the plurality of sections which it is in contact in order for the sections to telescope.

The present invention pertains to a method for using an access ladder attached to an end of an access hole of a building. The method comprises the steps of telescoping a plurality of sections of the ladder into an extended position from a retracted position, where the sections are folded on top of each other, by sliding each section down over another section behind it which preferably also causes the steps of the sections to unfold. There is the step of placing a bottom section of the plurality of sections in contact with the ground.

BRIEF DESCRIPTION OF THE DRAWINGS

In the accompanying drawings, the preferred embodiment of the invention and preferred methods of practicing the invention are illustrated in which:

FIGS. 16A and 16B show a step in the folded position.

FIGS. 16C and 16D show a step in the unfolded position.

FIG. 16E is a side view of the rung.

FIG. 16F is a perspective view of a step link.

FIGS. 20A and B show overhead and side views of the access ladder in a retracted position along with preferred embodiment dimensions.

DETAILED DESCRIPTION

Figure 1:
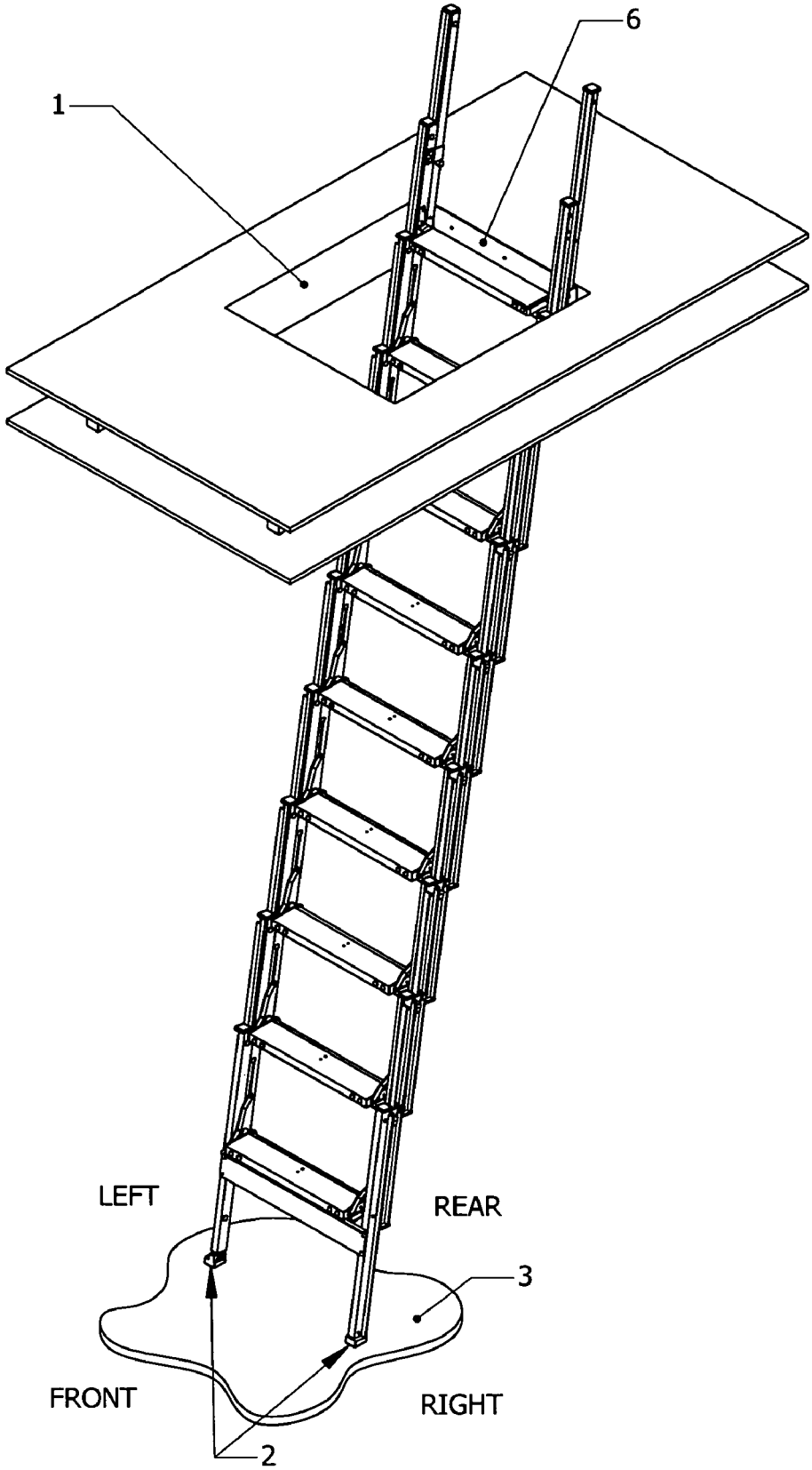
FIG. 1 is a perspective view of the access ladder of the present invention in an unfolded position.

Referring now to the drawings wherein like reference numerals refer to similar or identical parts throughout the several views, and more specifically to FIG. 1 thereof, there is shown an access ladder 110 for an access hole 1 in a building. The ladder 110 comprises a plurality of sections which telescope relative to each other between an extended position, where the sections define a plane 100 and a user can climb the sections, and a retracted position where the sections are folded on each other. Several of the sections have a least one step 14 which preferably moves between an unfolded position where the user can stand on the step 14 when the sections are in the extended position, and a folded position when the sections are in the retracted position. Each section slides relative to another section of the plurality of sections which it is in contact in order for the sections to telescope. It should be noted the step 14 can be fixed to the section.

Preferably, the ladder 110 includes a mounting section 5 for attachment to an end of the access hole 1. The plurality of sections preferably include a top section 10 which slidingly connects with the mounting section 5. Preferably, the plurality of sections includes a plurality of middle sections 19. The plurality of sections preferably includes a bottom section 27 which contacts a floor 3 when the sections are in the extended position.

Preferably, each section has opposing side rails 12. The middle sections 19 and the bottom section 27 preferably have a step stop 23 attached to each side rail 12 which contacts and unfolds a folding step 14 attached to the section immediately behind it as the section moves into the extended position. Preferably, the side rails 12 of the bottom, middle and top sections 27, 19, 10 have at least one notch.

The middle and bottom sections 19, 27 preferably have springs 47 which contact the step 14 to cause the step 14 to move into the folded position as the section moves into the retracted position.

Preferably, when the top, middle and bottom sections 10, 19, 27 are moving to the extended position, each section of the top, middle and bottom sections 10, 19, 27 slide downward a distance of half its length relative to the section immediately behind it before being stopped. Each section when moving into the retracted position preferably rises until it is even with the section immediately behind it before being stopped.

Preferably, each rail of each section has a top cap 9 and a bottom cap 57. Each of the top caps 9 slightly overlaps the rail in front of the rail to which it is attached. Each of the bottom caps 57 overlaps the rail behind the rail to which it is attached, wherein the overlapping allows the rail to move downward relative to the rail behind it but positively blocks any rail from rising above the rail behind it. Each rail of the top and middle section 19 preferably has a t-rocker 18 pivotally attached to it. When the sections are in the retracted position, the t-rockers 18 protrude through the notch of the rail immediately behind the rail to which it is mounted. When the sections are moved into the extended position, as the notch in the rail immediately in front of the rail to which it is attached passes the t-rocker 18, the t-rocker 18 pivots so the t-rocker 18 releases the section to which it is attached from the section immediately behind it, allowing the section to which it is attached to be pulled down.

The present invention pertains to a method for using an access ladder 110 attached to an end of an access hole 1 of a building. The method comprises the steps of telescoping a plurality of sections of the ladder 110 into an extended position from a retracted position, where the sections are folded on top of each other, by sliding each section down over another section behind it which also causes the steps 14 of the sections to unfold. There is the step of placing a bottom section 27 of the plurality of sections in contact with the ground.

Preferably, the telescoping step includes the step of moving step stops 23 on middle sections 19 of the plurality of seconds against steps 14 to cause the steps 14 to unfold. The telescoping step preferably includes the step of pivoting a t-rocker 18 pivotally attached to a middle section 19 of the plurality of sections so the t-rocker releases the section to which it is attached from a section of the plurality of sections immediately behind it, allowing the section to which it is attached to be pulled down.

Figure 2:
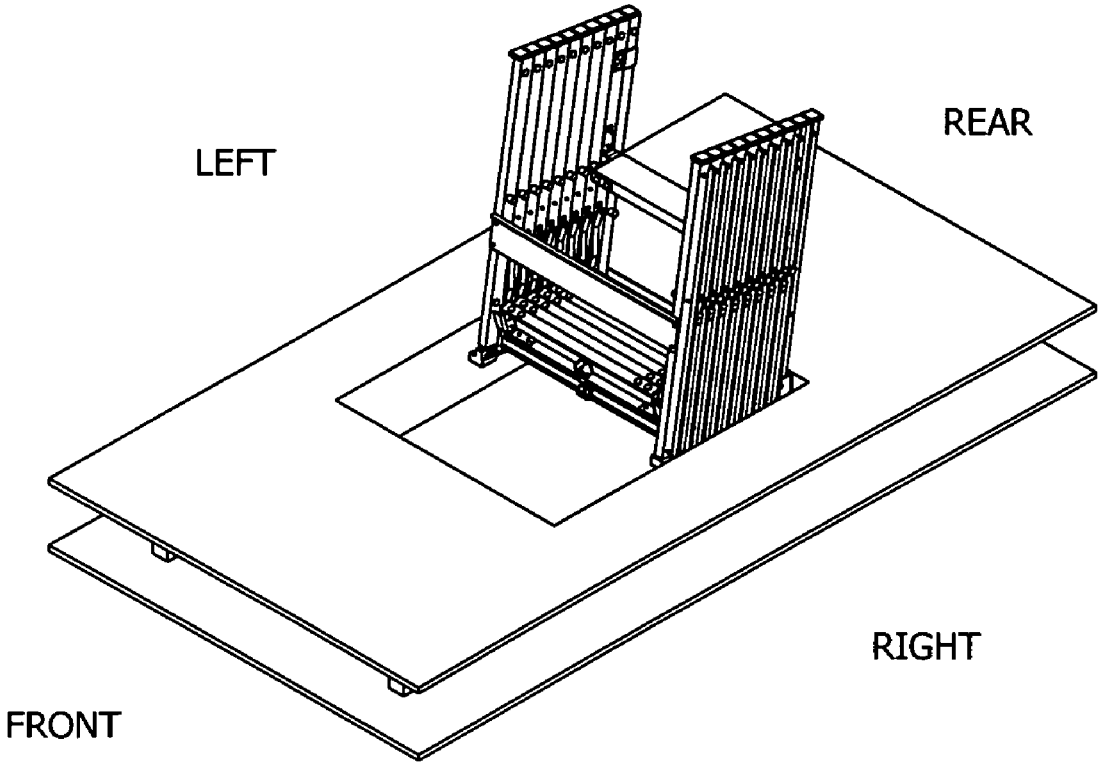
FIG. 2 is a perspective view of the access ladder in a retracted position.
Figure 3A:
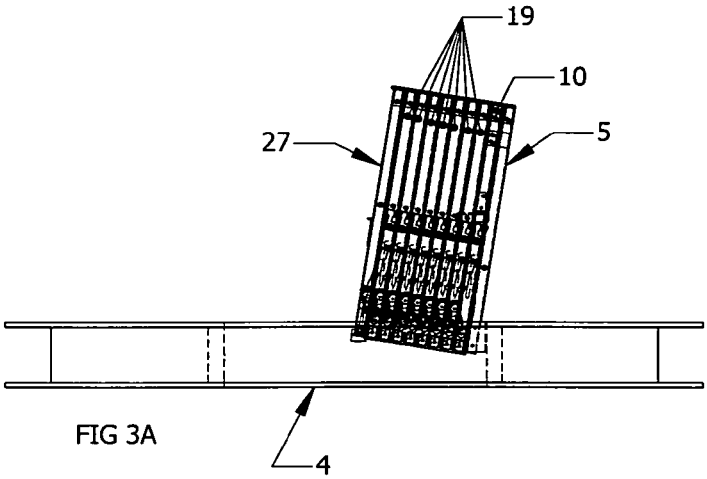
FIG. 3A is a side view of the access ladder in the retracted position.
Figure 3B:
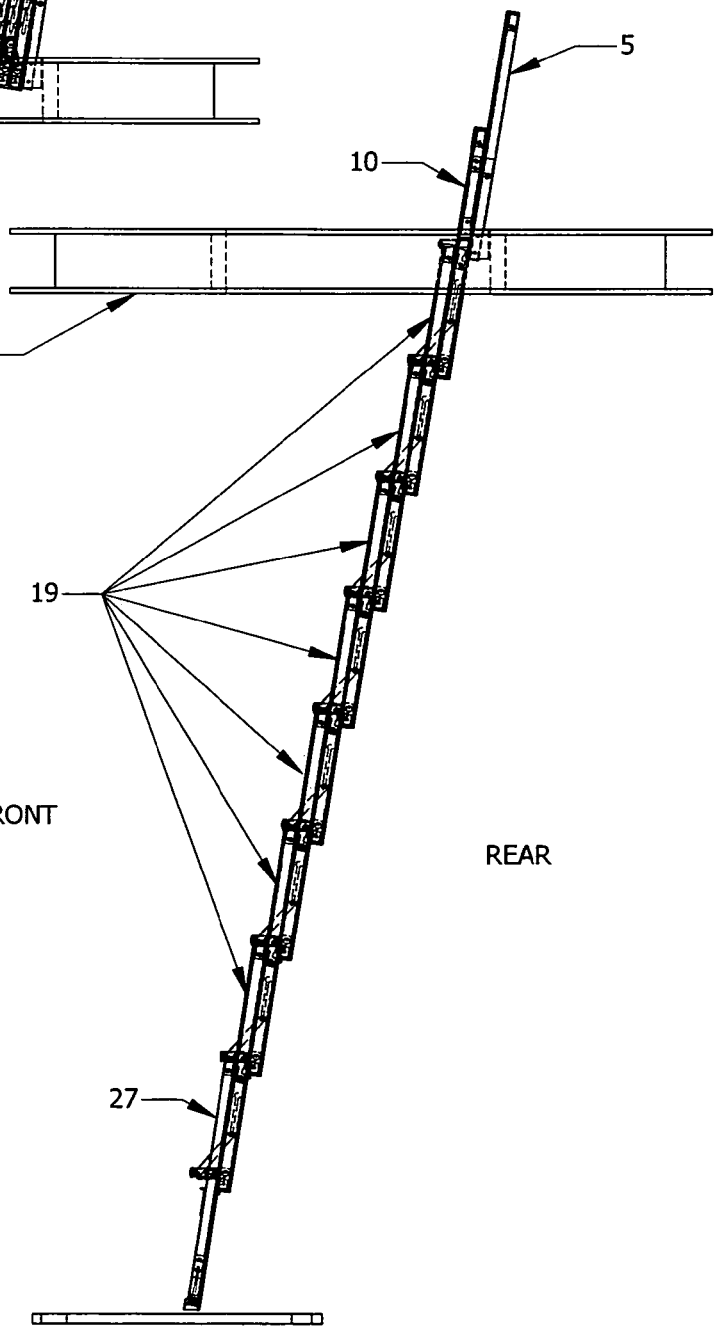
FIG. 3B is a side view of the access ladder in an unfolded position.

In the operation of the preferred embodiment, FIGS. 1, 2, and 3 show overall views of the ladder. Left, right, front and rear are defined in those views. Basically, this ladder "telescopes" between its extended and retracted positions. Its steps unfold when the ladder is extended and fold as the ladder is retracted. FIG. 1 shows the ladder fully extended with the steps unfolded. A small section of the ceiling with the access hole 1 is shown for reference. In this position the feet 2 of the ladder are resting on the floor 3. FIG. 2 shows the ladder completely retracted with its steps folded. FIGS. 3A and 3B are right side views of the ladder in the retracted and extended positions respectively, showing how the ladder is positioned relative to the ceiling 4.

The ladder consists of several sections which slide relative to each other when the ladder is extended or retracted.

Figure 4:
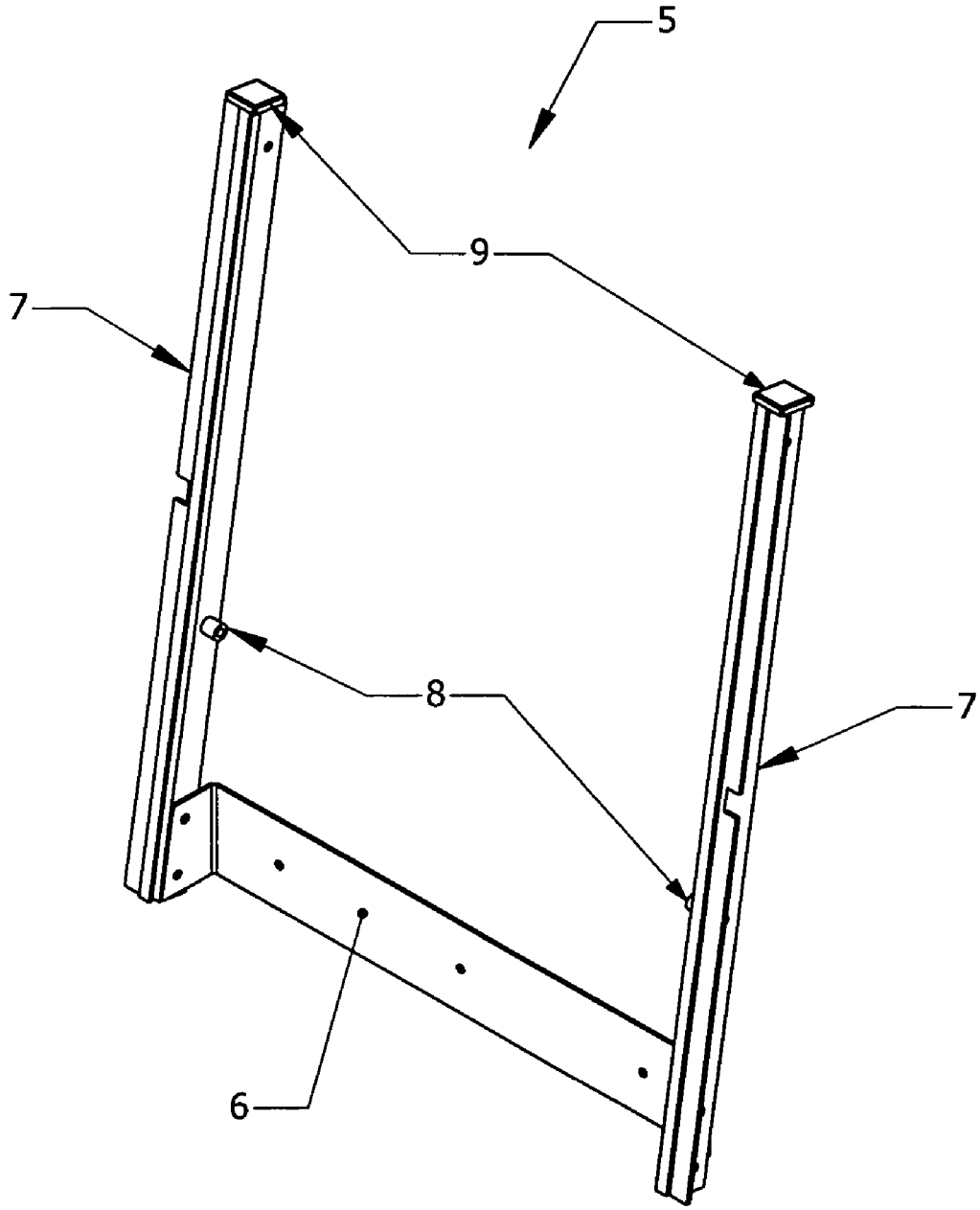
FIG. 4 is a perspective view of a mounting section.

The mounting section 5 is shown in FIG. 4 and FIG. 3. This section consists of a steel mounting bracket 6 which rigidly connects the two aluminum side rails 7 and also attaches directly to the end of the access hole (FIG. 1). Two top stops 8 and two top caps 9 are attached as shown. The ladder has only one mounting section.

Figure 5:
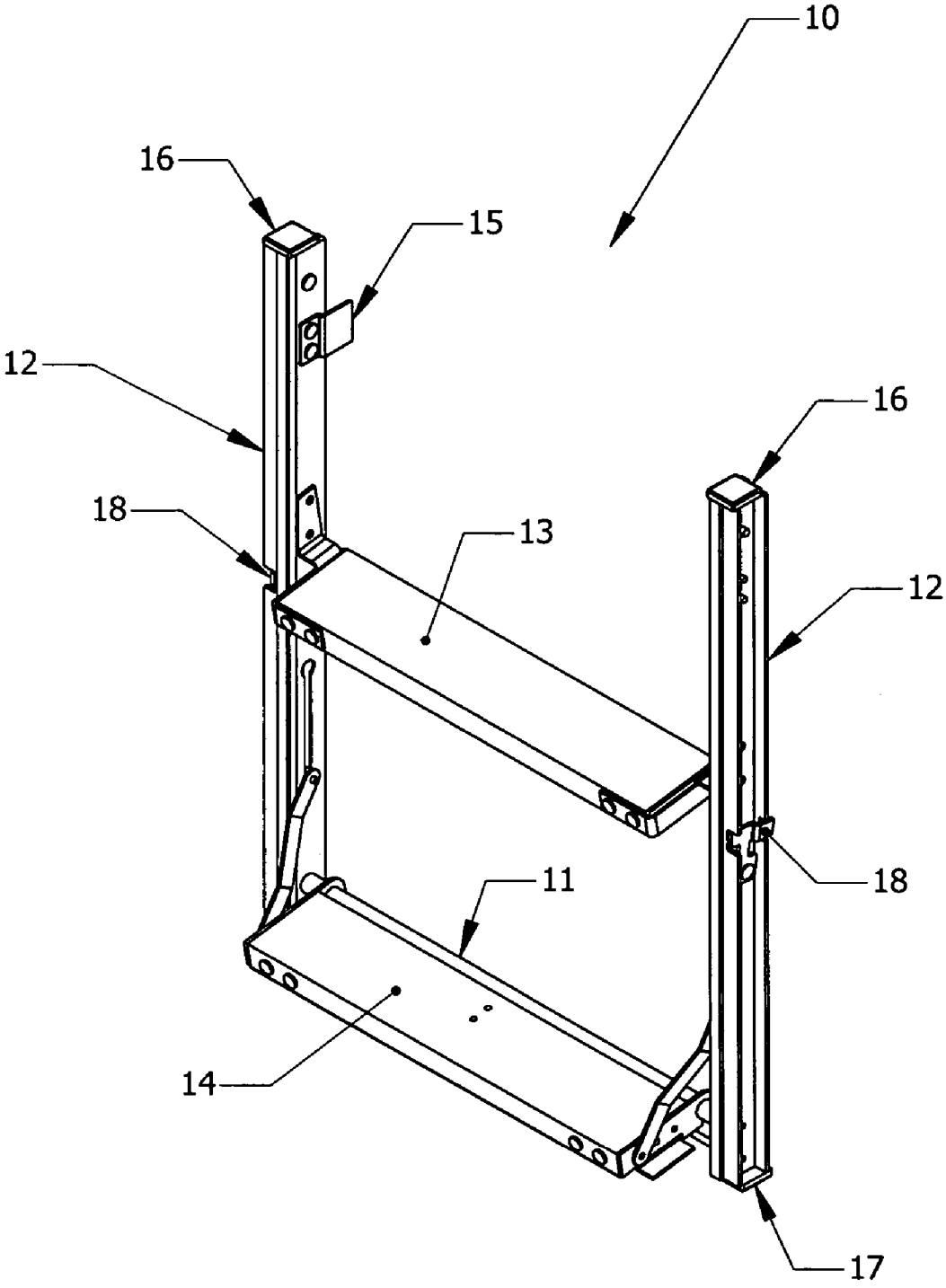
FIG. 5 is a perspective view of a top section.

The top section 10 is shown in FIG. 5 and FIG. 3. This section consists of an aluminum rung 11 which rigidly connects two side rails 12. This section has one fixed step 13 and one folding step 14. Two stop brackets 15, two top caps 16 and two bottom caps 17 are attached as shown. A t-rocker 18 is attached to each side rail. The t-rocker function will be explained later. The ladder has only one top section.

Figure 6:
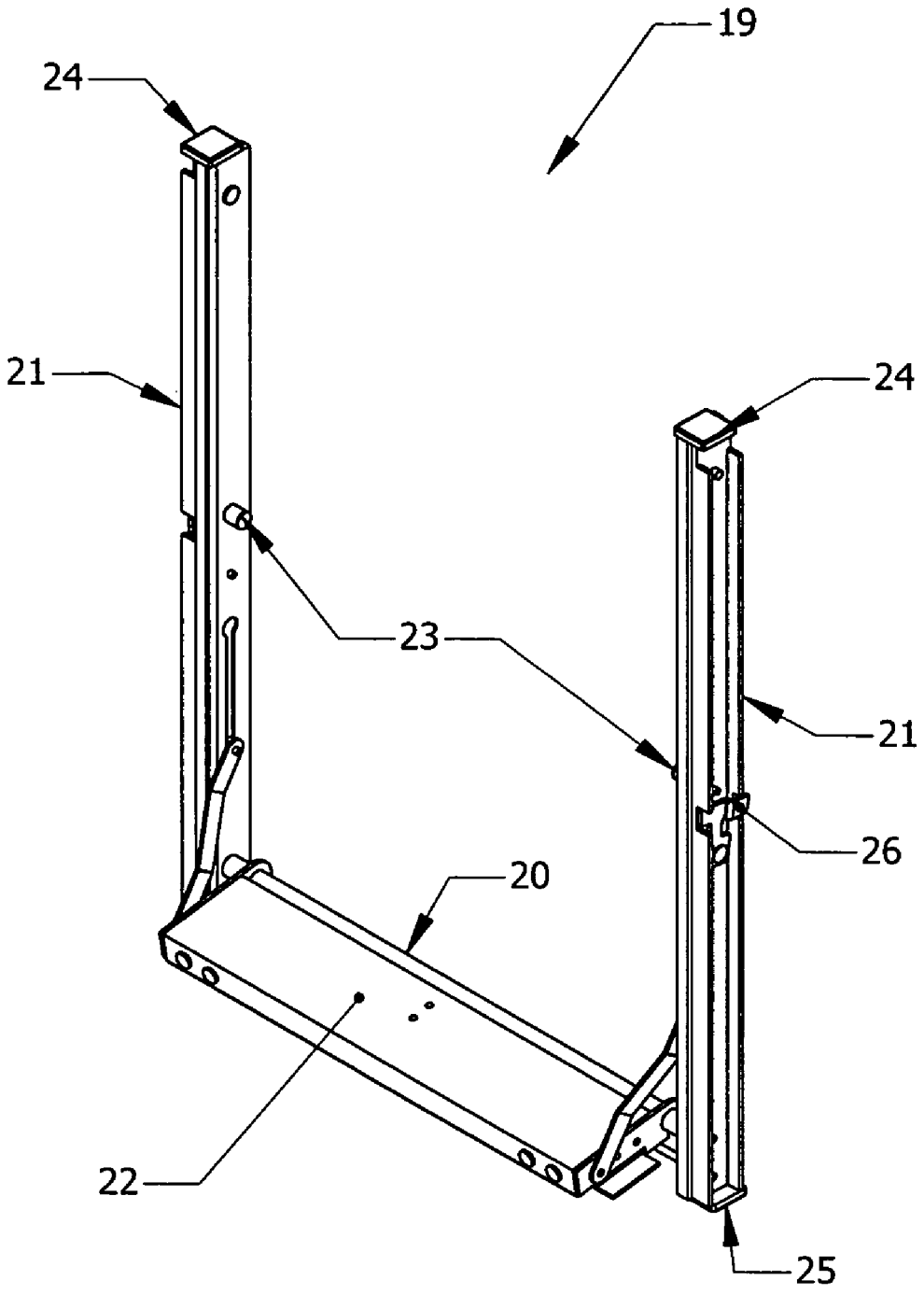
FIG. 6 is a perspective view of a middle section.

A middle section 19 is shown in FIG. 6 and FIG. 3. This section consists of a rung 20 which rigidly connects two side rails 21. Each middle section has a folding step 22. Two step stops 23, two top caps 24, and two bottom caps 25 are attached as shown. A t-rocker 26 is attached to each side rail. There are seven identical middle sections in the ladder.

Figure 7:
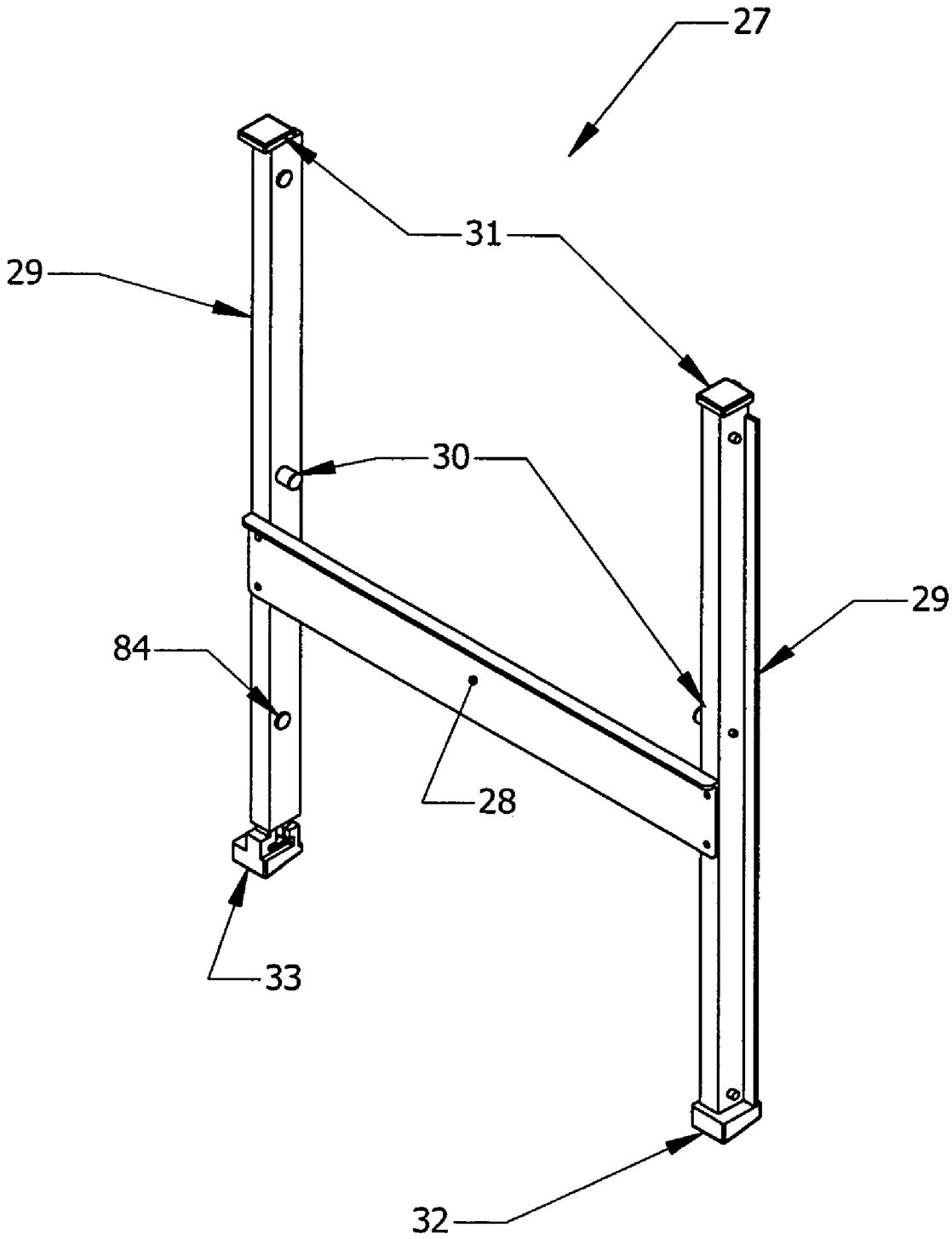
FIG. 7 is a perspective view of a bottom section.
Figure 8A:
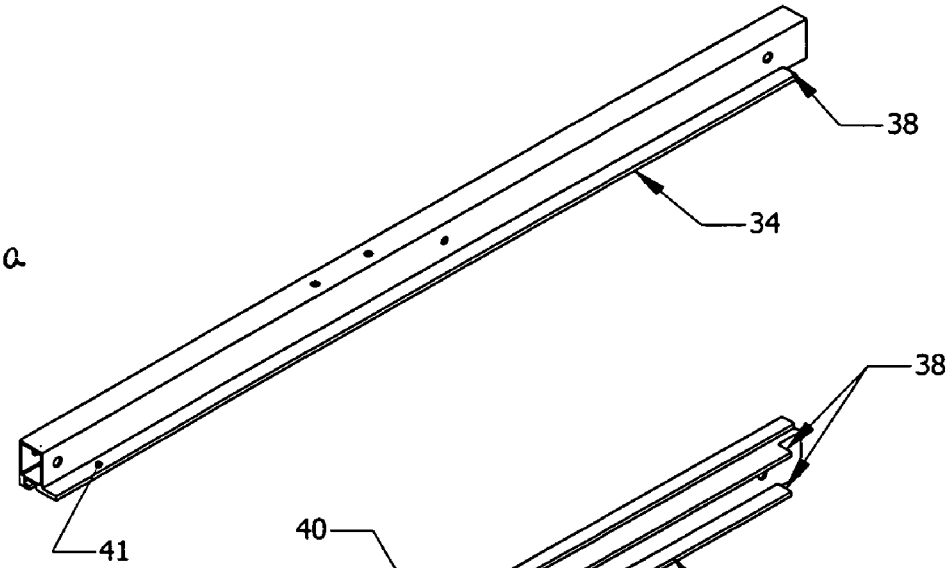
FIGS. 8A-D are perspective views of the right side rails of a bottom section, middle section, top section and a mounting section, respectively.
Figure 8B:
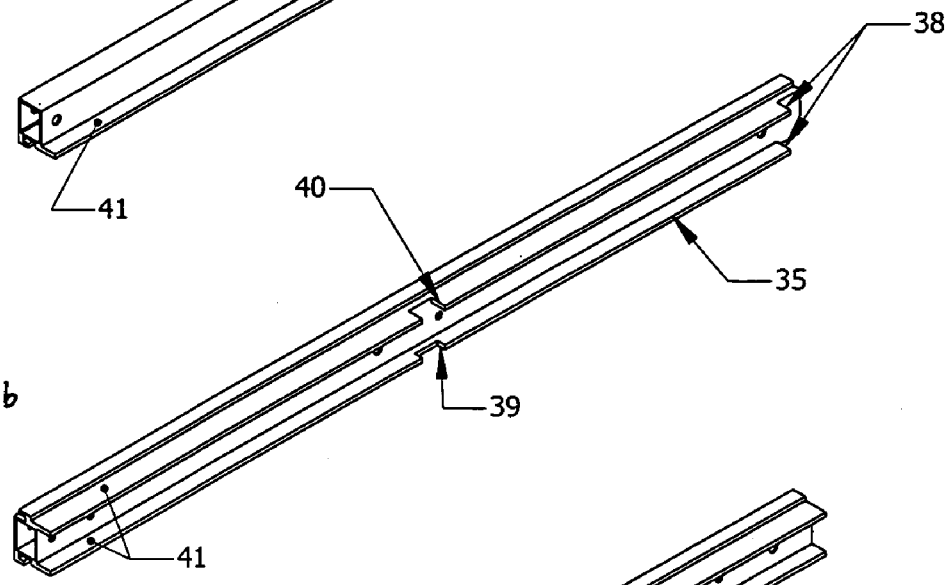
Figure 8C:
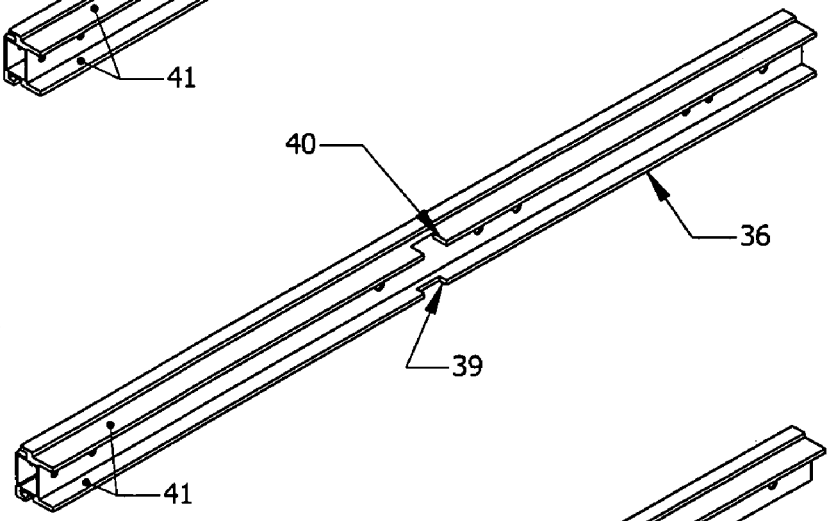
Figure 8D:
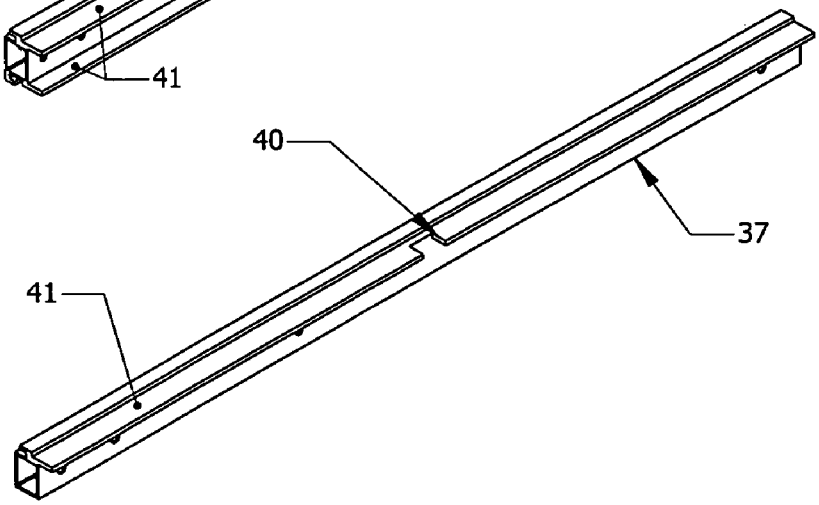

The bottom section 27 is shown in FIG. 7 and FIG. 3. This section consists of an aluminum cross piece 28 which rigidly connects two side rails 29. Two step stops 30 and two top caps 31 are attached as shown. There is also one fixed foot 32 and one adjustable foot 33. The ladder has only one bottom section.

Each of the different types of side rails used in the various sections is shown in FIG. 8. Only the right side rails are shown but the left side rails are mirror images of the right side rails 34 is a bottom section rail, 35 is a middle section rail, 36 is a top section rail, 37 is a mounting section rail. Holes for mounting various parts can be seen in rails. In addition, there are end notches 38 and mid notches 39 and 40 cut into the flanges 41 of the rails. Mid notches 39 are cut half as deep as mid notches 40 and the end notches 38. Notice that each rail type has its own unique number and arrangement of flanges and notches.

Figure 9:
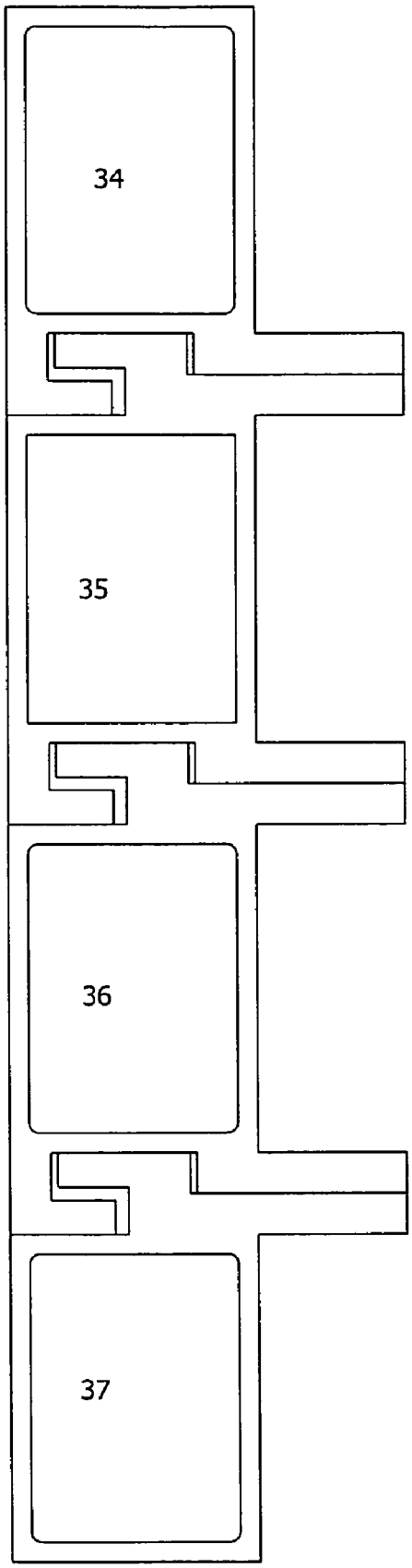
FIG. 9 is a side view showing how the cross-sectional shape of the side rails enable them to interlock with each other.

FIG. 9 shows how the cross-sectional shape of the side rails 34, 35, 36, and 37 enable them to interlock with each other. For simplicity's sake, only one middle section right hand rail 35 is shown instead of the seven that would be in a ladder, but the entire assembly of sections would interlock in the same way. There is enough clearance between the rails to allow them to slide freely relative to each other along their long axes.

Details of how the folding steps are attached and function are shown in FIG. 16. FIGS. 16A and 16B (with right side rail hidden) show the step in the at rest or folded position. FIGS. 16C and 16D (with the right side rail hidden) are in the unfolded position. The rung 42 connects the right hand and left hand rails together and provides a pivot for the step 43. The shape of the rung is seen in FIG. 16E. Step links 44 (also FIG. 16F) are pivotally attached to each end of the step and have a projection 45 that rides in a slot 46 in the rails. When the step is fully unfolded the projection on the step link bears against the end of the slot, thus solidly supporting the step in its unfolded position. A torsion spring 47 is attached to the underside of the step. One leg of the torsion spring bears against the step while the other leg bears against a bumper 48 attached to the rung. The force of the torsion spring is sufficient to move the step from the unfolded to the folded position. The folded position is reached when projections 49 on the back of the step encounter the web 50 of the rung. Each step has flat projections 51 at both ends whose function will be explained later.

Ladder Section Travel Limits and Step Unfolding and Folding

When the ladder is extended from its fully retracted position (FIG. 3A), the bottom section descends first until it has moved half its length relative to the first middle section immediately behind it. At that point, the bottom section and the first middle section descend together until the first middle section has moved half its length relative to the next middle section immediately behind it. This sequence continues until finally the top section has either moved half its length relative to the mounting section or the feet have contacted the floor (FIG. 3B).

When the ladder is being retracted, initially the entire ladder moves up relative to the mounting section until the top section has fully retracted relative to the mounting section. At that point the top section stops and the rest of the ladder continues to move up until the rearmost middle section is fully retracted relative to the top section and it stops. This sequence continues until finally the bottom section is fully retracted relative to the first middle section. This sequence of extending and retracting in succession is controlled by the action of the t-rockers which will be described later.

From the above description, it can be summarized that when extending, each section must be able to slide downward a distance of half its length relative to the section immediately behind it before being stopped. Also, each section when retracting will rise until it is even with the section immediately behind it before being stopped.

Figure 10:
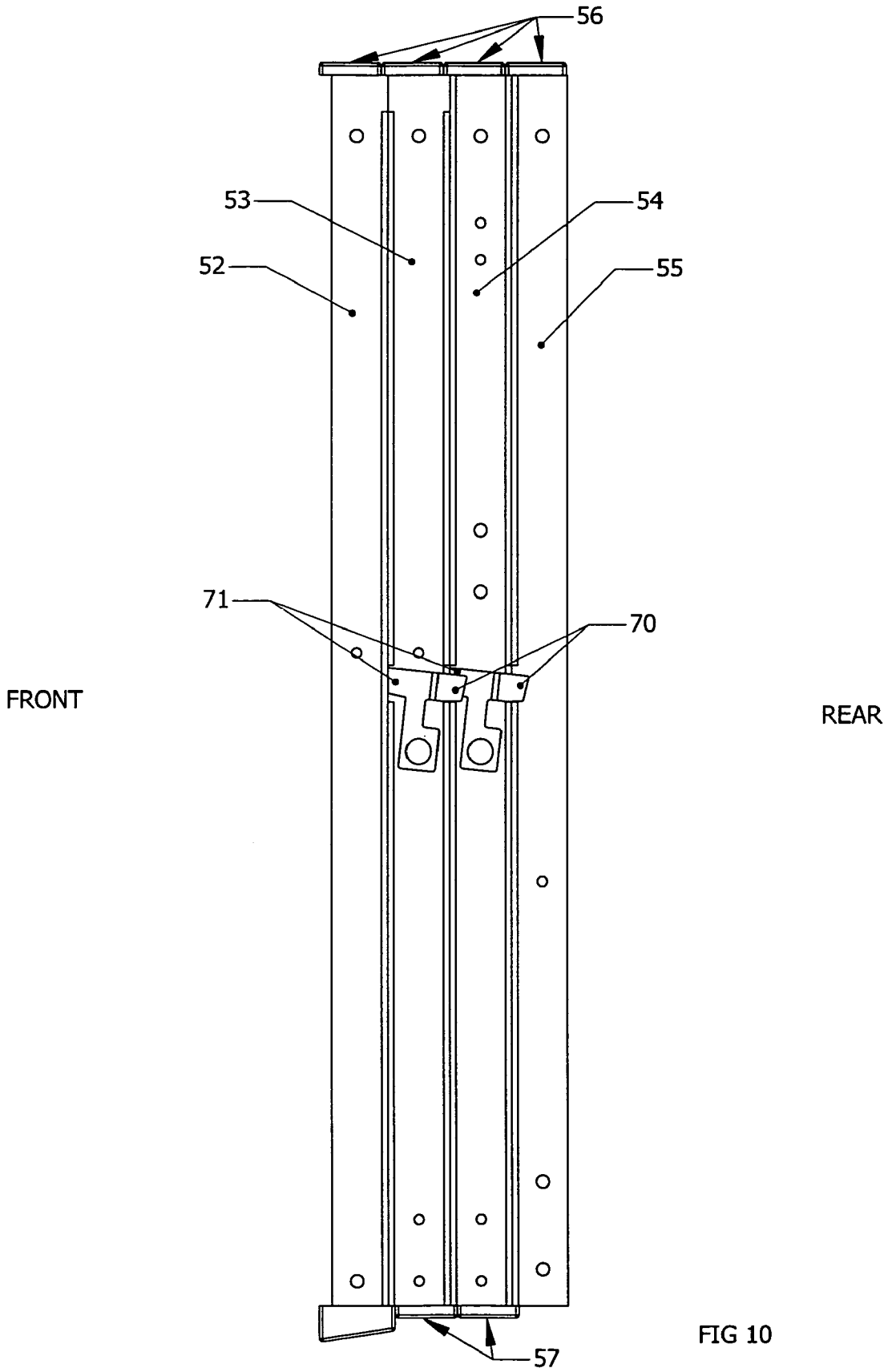
FIG. 10 is a side view of the access ladder in a retracted position.

Stopping in the proper location is accomplished as follows:

During retraction, sections are positively stopped in the right location by the action of the top caps and bottom caps. FIG. 10 is a right side view of a bottom section 52, a middle section 53, a top section 54, and a mounting section 55. An actual ladder would have seven middle sections but only one is shown for simplicity. It can be seen that each of the top caps 56 slightly overlaps the rail in front of the rail to which it is attached. Similarly, each of the bottom caps 57 slightly overlaps the rail behind the rail to which it is attached. This overlapping allows any rail to move downward relative to the rail behind it but positively blocks any rail from rising above the rail behind it.

Figure 17A:
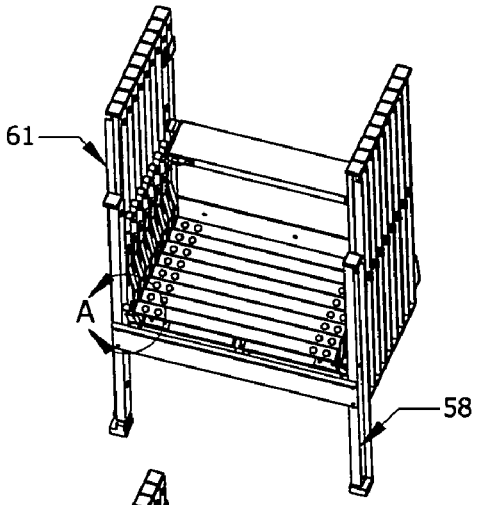
FIGS. 17A-F show the access ladder in a retracted position with the bottom section starting to be pulled down, and sectional views thereof.
Figure 17D:
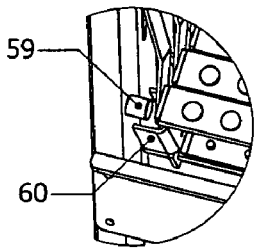
Figure 17B:
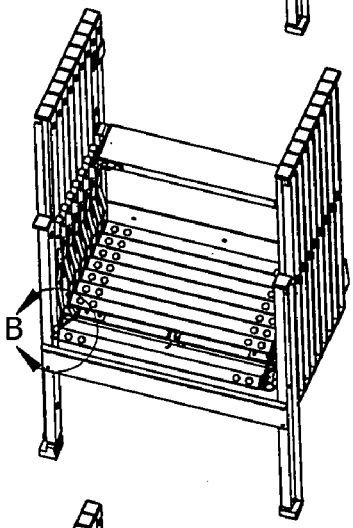
Figure 17E:
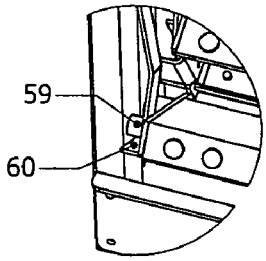
Figure 17C:
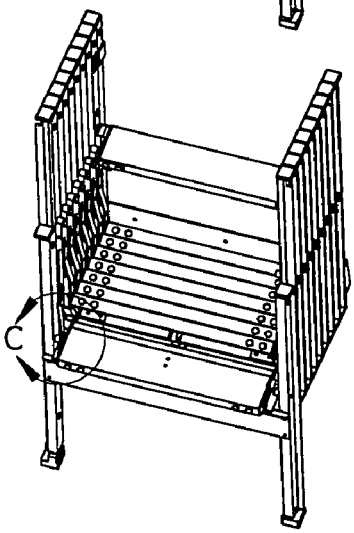
Figure 17F:
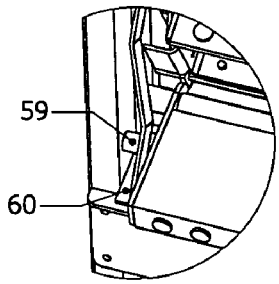

During extension, sections are positively stopped after they have moved downward a distance of half their length by the step stops of that section contacting and unfolding the folding step attached to the section immediately behind it. This can be seen in FIG. 17. In FIG. 17A, the bottom section 58 is descending. The step stops 59 on the bottom section are about to contact the flat projections 60 on the folding step of the first middle section 61 as seen in DETAIL A. In FIG. 17B, the step stops 59 have partially unfolded the step as the bottom section continues to descend. Finally, in FIG. 17C, the folding step has been completely unfolded and has stopped in the position also seen in FIG. 16D. Because the step can unfold no further, the bottom section is stopped as well. This action is repeated as each successively rearward section descends. The only exception to this is when the top section descends relative to the mounting section. If the feet of the ladder do not contact the floor beforehand, then the stop brackets 15 on the top section (FIG. 5) contact the top stops 8 on the mounting section (FIG. 4).

An important advantage in having the steps spring loaded towards the folded position is that the downward extension of the sections is retarded by each section having to unfold the step on the section immediately behind it. In other words, the ladder will not extend out of control but must be pulled open a section at a time.

The folding steps fold up under the influence of the torsion springs 47 (FIG. 16) as soon as the section in front of the section to which the folding step is attached begins to rise. As that section in front rises, its step stops also move up, allowing the folding step to fold up.

Function of the t-Rockers

Figure 18A:
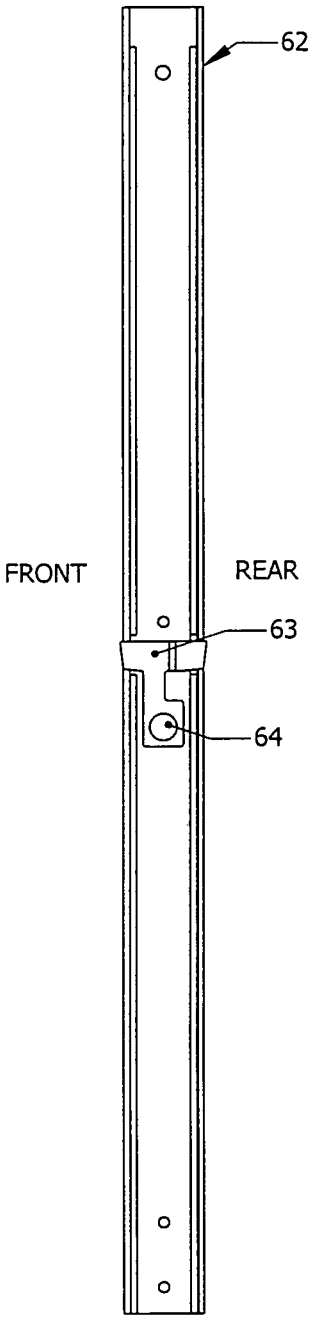
FIGS. 18A-D show the action of the t-rocker between the unfold position and the retracted position.
Figure 18B:
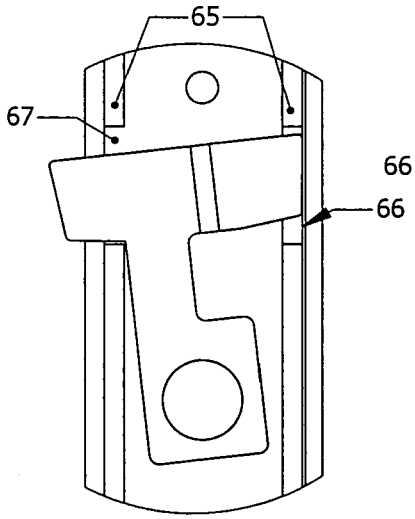
Figure 18C:
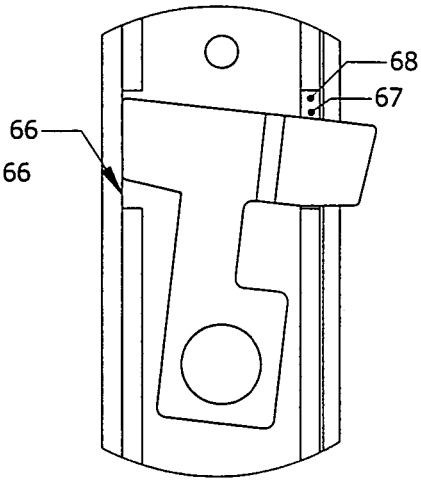
Figure 18D:
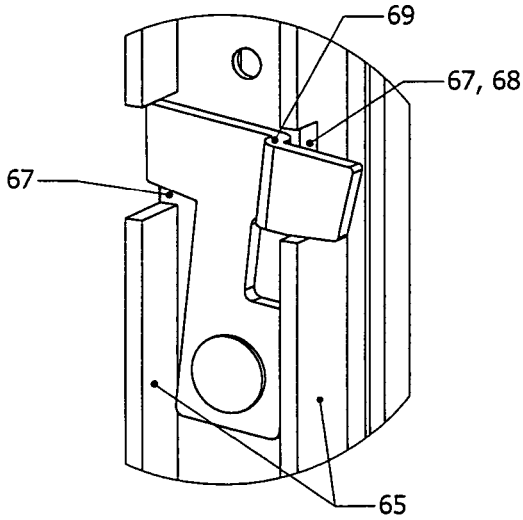

FIG. 18A shows a typical right side rail 62 with a t-rocker 63 attached. Front and rear directions are indicated. The t-rocker is free to pivot about the rivet 64 that holds it to the rail. The t-rocker is shown pivoted to its extreme forward and rearward positions in the detail FIGS. 18B and 18C, respectively. Its pivoting is limited by the flanges 65 of the rail. Notice that at the limits of its travel, one horizontal arm of the "T" of the t-rocker is inboard of the outer edge 66 of the flange and the other arm protrudes through a notch 67 in the flange on the opposite side. Notice that when the t-rocker is in its rearward position, the horizontal arm of the t-rocker is protruding through a half depth notch 68. This is possible because of the offset 69 in the t-rocker, seen in FIG. 18D.

Now refer to FIG. 10. Again, FIG. 10 is a right side view of a bottom section rail 52, a middle section rail 53, a top section rail 54, and a mounting section rail 55. An actual ladder would have seven middle sections but only one is shown for simplicity. All steps, etc. have been omitted as well. The mounting section rail 55 may be considered as fixed in place. It should be noted that the operation of all the t-rockers on the left side of the ladder is the same as those on the right side.

Figures 11A, 11B:
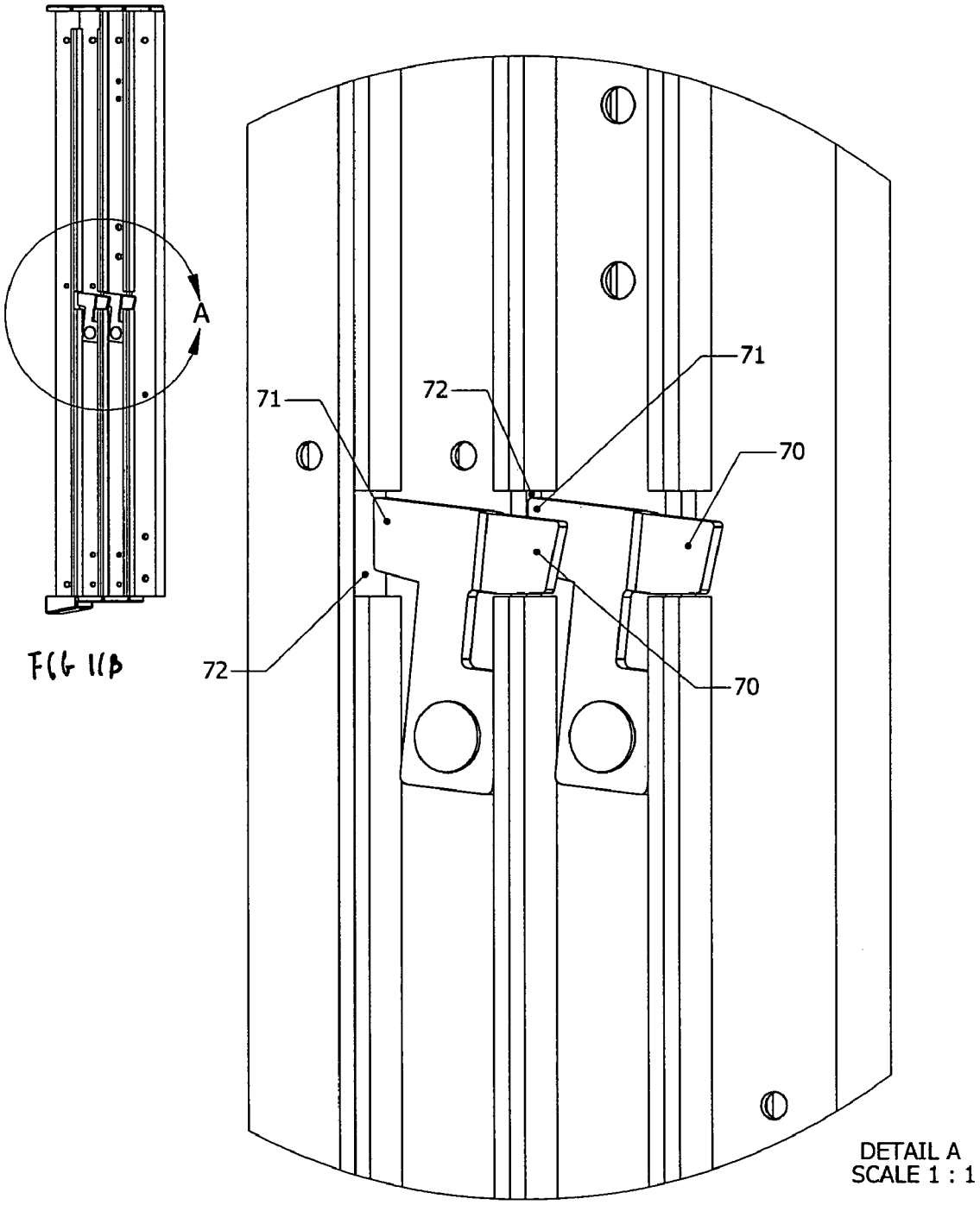
FIGS. 11A and 11B show a side view of the access ladder in a retracted position and a sectional view of FIG. 11A, respectively.

This representative ladder in FIG. 10 is shown in the fully retracted position. Note that the t-rockers are in their rearward position. Notice that the rear horizontal arm 70 of both t-rockers is protruding through the notch of the flange of the rail on which it is mounted and also protruding through the notch of the flange of the rail immediately to the rear of the one on which it is mounted. The t-rockers cannot pivot out of their rearward position because the forward horizontal arm 71 of both t-rockers is blocked by a solid section of the flange on the rail immediately in front of the rail on which the t-rocker is mounted. This can be seen in FIG. 11 which is a perspective and detail view of the ladder in FIG. 10. Note the solid sections of the flanges 72.

So, when the ladder is in the configuration of FIG. 10, the top rail is "hooked" to the mounting rail and prevented from sliding by its t-rocker, and the middle rail is hooked to the top rail by its t-rocker. Thus, the only rail that is not immovably hooked to another rail is the bottom rail in front.

Figure 12B:
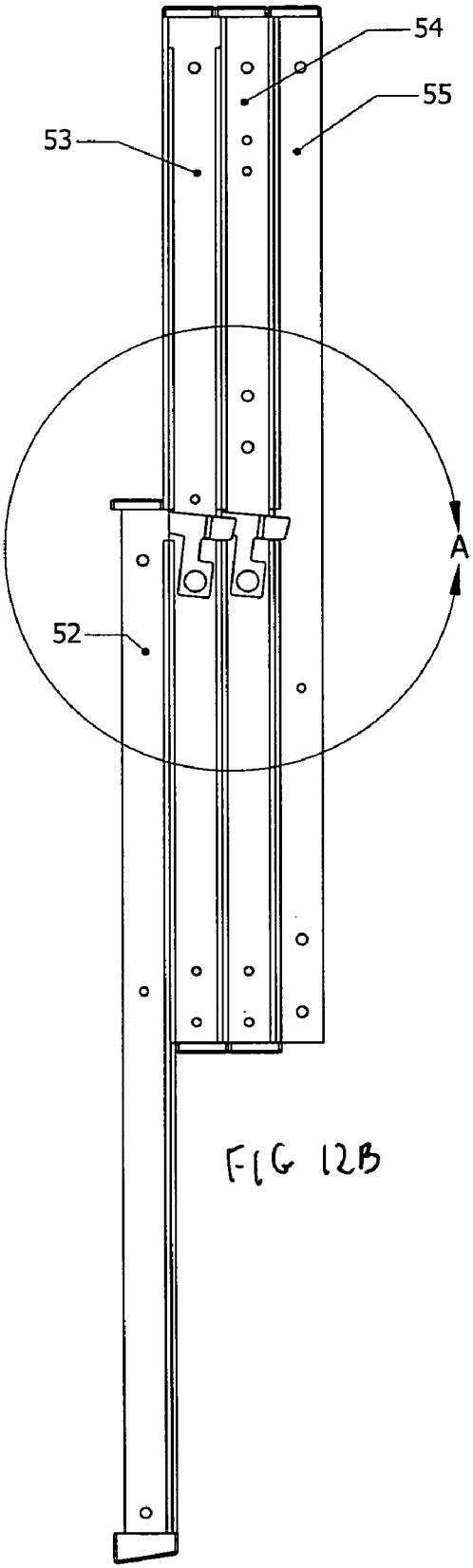
FIGS. 12A and 12B show a side view of the access ladder with the bottom section pulled down and a sectional view of FIG. 12A, respectively.
Figure 12A:
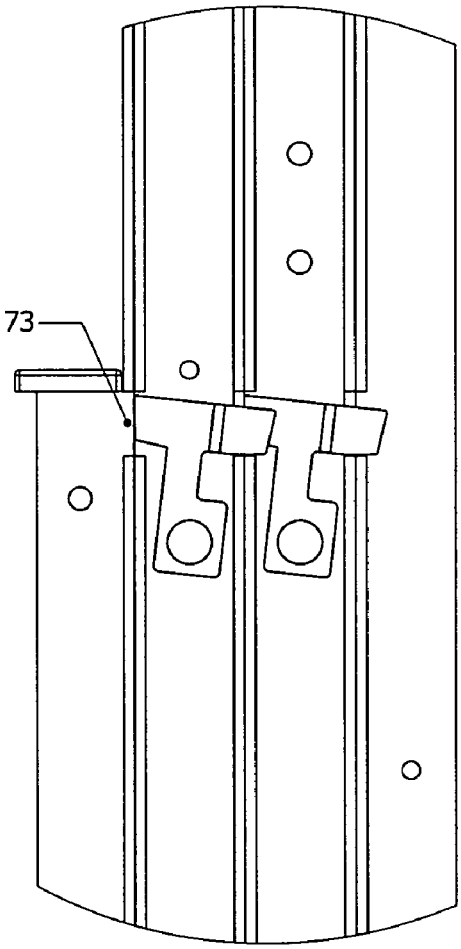

In FIG. 12, the bottom section rail 52 has been pulled down to the point at which it would be stopped by the unfolding of the step on the middle section rail as described earlier. Notice that the end notch of the bottom rail 73 is now lined up with the forward horizontal arm of the t-rocker on the middle rail.

Figure 13B:
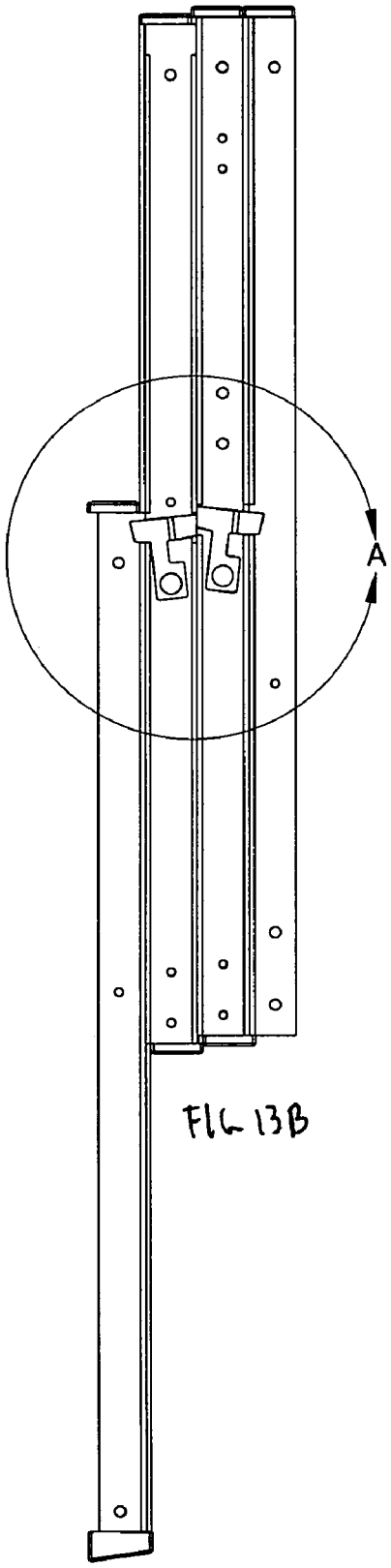
FIGS. 13A and 13B show a side view of the access ladder with the bottom section pulled down and a sectional view of FIG. 13A.
Figure 13A:
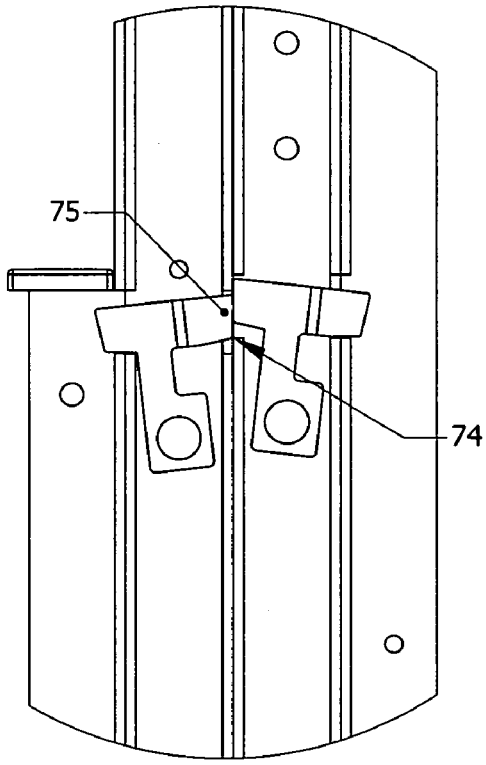

That t-rocker is now free to pivot forward. See FIG. 13. The bottom rail 52 and the middle rail 53 have descended together (because of the step stop and step interaction) a short distance. Because the top rail 54 still cannot move, the edge of the notch 74 in the top rail pushes up on the rear arm of the middle rail's t-rocker 75, causing that t-rocker to pivot forward so that the forward arm of the t-rocker protrudes into the end notch of the bottom rail and causing the rear arm of that t-rocker 75 to disengage from the notch in the top rail. Thus, the middle rail has been unhooked from the top rail.

Figure 14A:
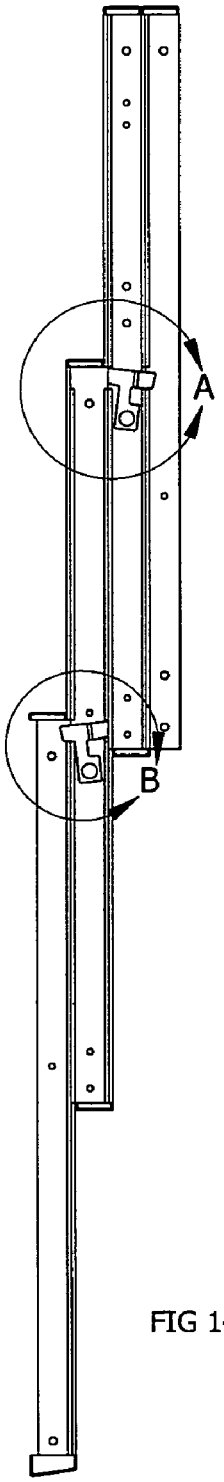
FIGS. 14A, 14B and 14C show a side view of the access ladder with the bottom and middle section pulled down, and sectional views of FIG. 14A, respectively.
Figure 14B:
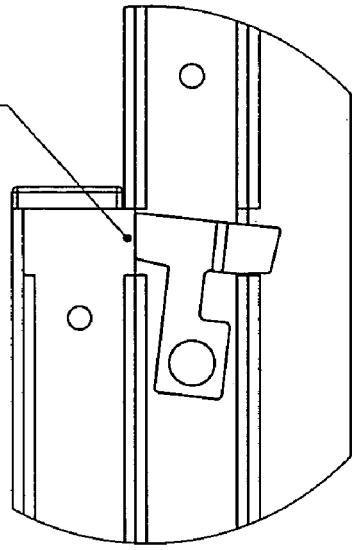
Figure 14C:
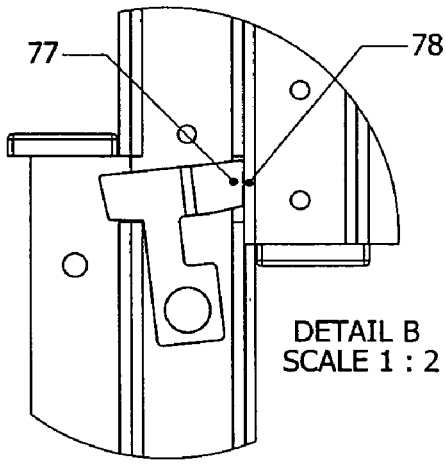

See FIG. 14A. At this time, the bottom rail 52 and the middle rail 53 have descended until the middle rail is stopped by the step stop on the middle rail unfolding the step on the top rail 54. Now the end notch in the middle rail 76 is lined up with the forward horizontal arm of the top rail's t-rocker as seen in FIG. 14B. It should be noted that as soon as the middle rail 53 began to descend relative to the top rail, the middle rail's t-rocker was prevented from pivoting back to the rear because the rear arm of that t-rocker 77 was blocked by the solid section of the flange 78 of the top rail. Thus, the middle section rail became hooked to the bottom section rail. This can be seen in FIG. 14C.

Figure 15A:
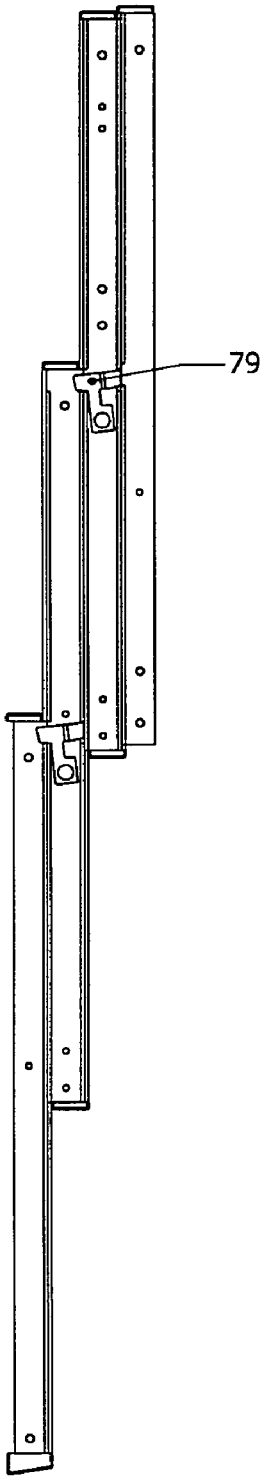
FIG. 15A shows a side view of the bottom section, middle section and top section when they have begun to descend together.
Figure 15B:
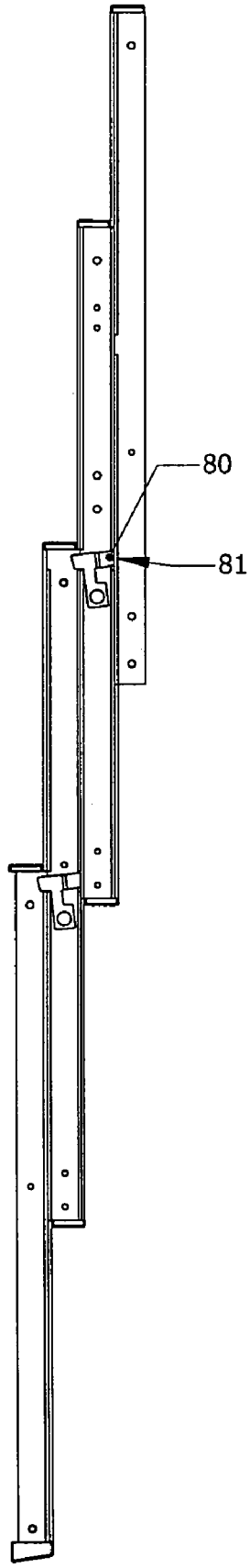
FIG. 15B shows a side view of the access ladder as the top section descends with the middle section and the bottom section.

FIG. 15A shows that the bottom rail 52, middle rail 53, and top rail 54 have begun to descend together. The top rail's t-rocker 79 has pivoted to its forward position, unhooking the top rail from the mounting rail 55 and hooking the top rail to the middle rail. FIG. 15B shows that as the top rail descends with the middle rail and bottom rail, the top rail's t-rocker cannot pivot back to its rear position because the rear horizontal arm of that t-rocker 80 is blocked by the solid section of the flange of the mounting rail 81.

The t-rocker operation described above is simply repeated for however many sections there are in the ladder. In summary: when the ladder is fully retracted, every moveable section (except the bottom section) is hooked to the section behind it by its t-rocker. Beginning with the bottom section, as each section is lowered to its full extent (call it the first section), it allows the t-rocker on the second section to unhook from the third section. The t-rocker on the second section rocks forward so that the second section is now hooked to the first section. The second section now becomes the new first section and the process repeats until the ladder is fully extended.

The operation is simply reversed when the ladder is retracted. The ladder is pushed up and as the t-rocker on the first rearmost moving section lines up with the notch in the stationary rail behind it, the t-rocker pivots rearward, hooking the first rearmost moving section to the already stationary section behind it and unhooking the first rearmost section from the second rearmost section. This repeats until the bottom section is finally pushed up into the retracted position.

Operating Range

Figure 21A:
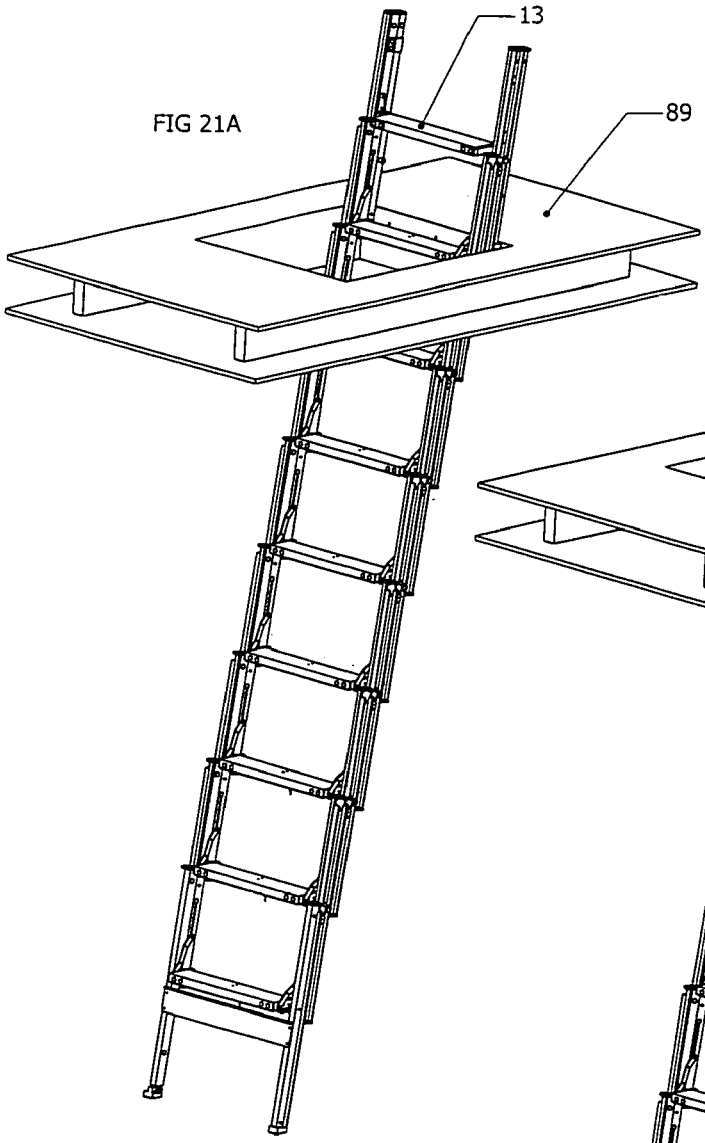
FIG. 21A shows the access ladder when extended from a 7 ft. 6 in. ceiling.
Figure 21B:
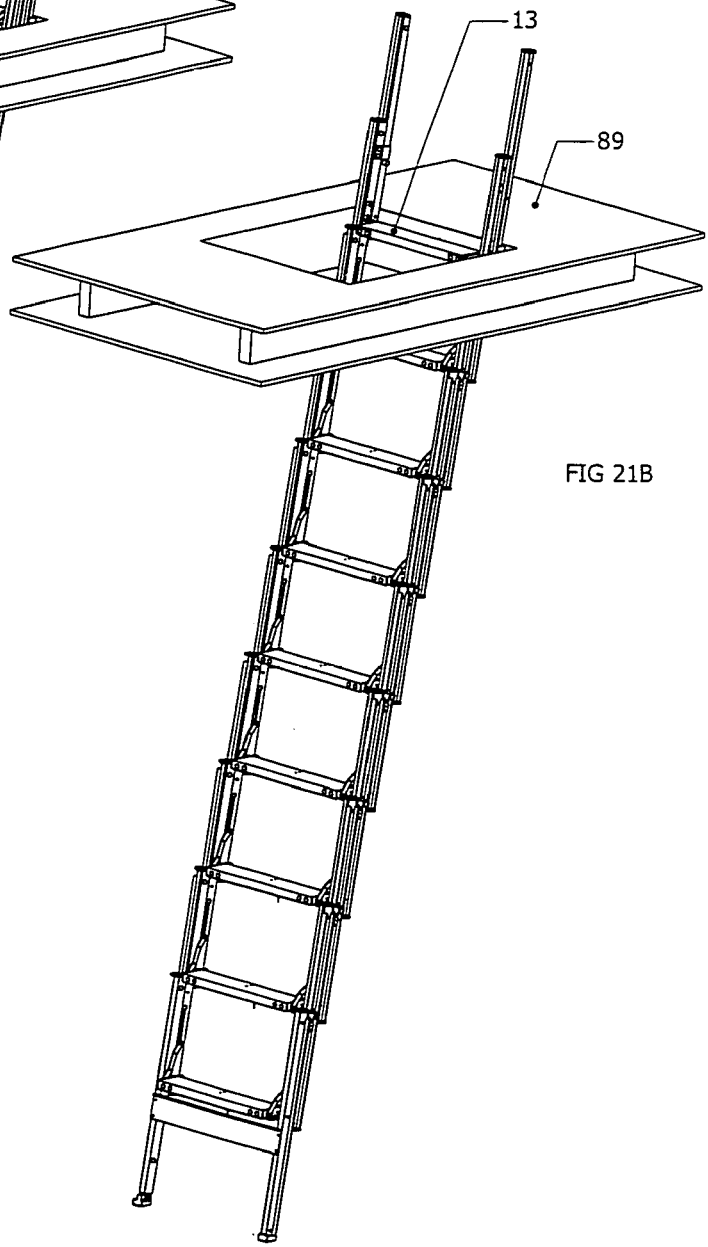
FIG. 21B shows the access ladder when extended from an 8 ft. 6 in. ceiling.

This ladder is designed to be used with floor to ceiling heights ranging from 7 feet 6 inches to 8 feet 6 inches. FIG. 21A shows the ladder when extended for a 7 foot 6 inch ceiling. FIG. 21B shows the ladder when extended for an 8 foot 6 inch ceiling. When used with a 7 foot 6 inch ceiling height, the top section will just have become hooked to the rearmost middle section by its t-rocker when the feet contact the floor. When used with an 8 foot 6 inch ceiling height, the stop brackets on the top section will be just short of contacting the top stops on the mounting section when the feet contact the floor. Thus when used as designed, the feet on the bottom section will always contact the floor before the top section has reached the limits of its downward travel relative to the mounting section.

Removable Step

When the ladder is fully extended with ceiling heights less than the full 8 foot six inches, the fixed step 13 of the top section 10 (FIG. 5) may end up above the level of the "floor" of the area above the access hole. This can be seen clearly in FIG. 21A where the fixed step 13 is above the flat area 89 above the access hole. Because this could be inconvenient for the end user this step will be made to be removable. Note in FIG. 21B that when the ladder is at or near a full 8 foot 6 inch extension, the top step 13 is below the level of 89 and would not be an inconvenience.

How Loads are Carried

This ladder design does not "hang" from the ceiling and carry loads in tension but rather carries loads in compression to the floor. Weight applied to any step of any section is transferred to the rails of that section, then to the t-rockers of that section, then to the rails of the section immediately in front of and below that section and so on until the weight is transferred to the floor through the feet.

Adjustable Foot

Figure 19:
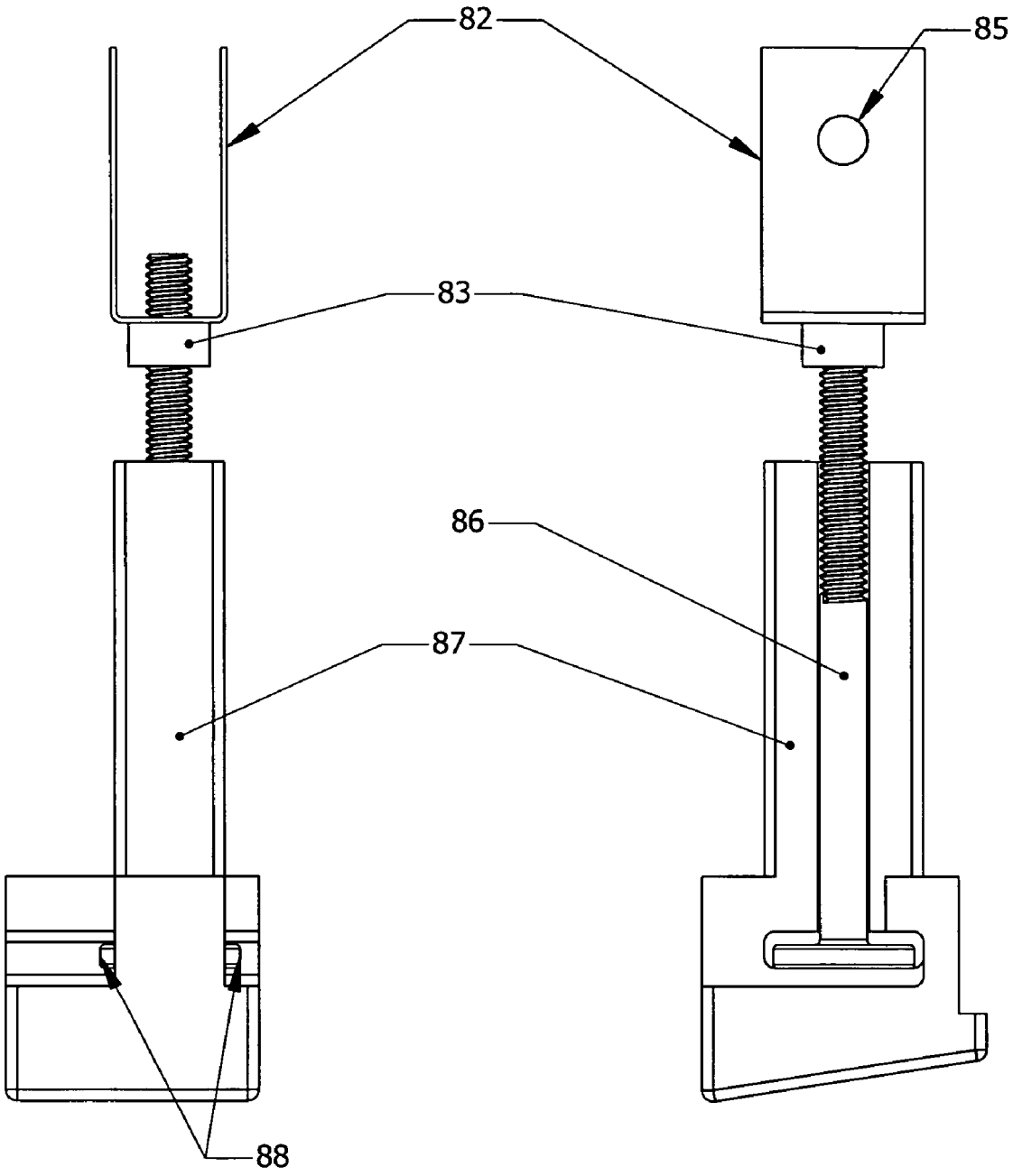
FIG. 19 shows the adjustable front mechanism.

In order to allow the ladder to rest solidly on the floor in spite of unevenness of the floor, one or both of the feet are adjustable. FIG. 7 shows the adjustable foot mechanism as attached to the left side rail of the bottom section. FIG. 19 shows the adjustable foot mechanism in detail. A bracket 82 with a female threaded nut 83 welded to it is attached to the inside of the left side rail of the bottom section with a rivet 84 (see FIG. 7) through the hole 85. A long adjuster bolt 86 lies in a recess in the side of the adjustable foot 87. The edges of the wide adjuster bolt head 88 protrude beyond the sides of the adjustable foot, enabling the bolt to be turned. By turning the adjuster bolt the adjustable foot is moved up or down relative to the left side rail.

Retracted Size

The compact size of the ladder can be seen in FIG. 20.

Functioning with a Spring-Loaded Door

To make it convenient for the user to extend the access ladder 110 even when the ceiling height is as great as eight feet, six inches, the ladder 110 can be used in conjunction with a door.

Figure 22A:
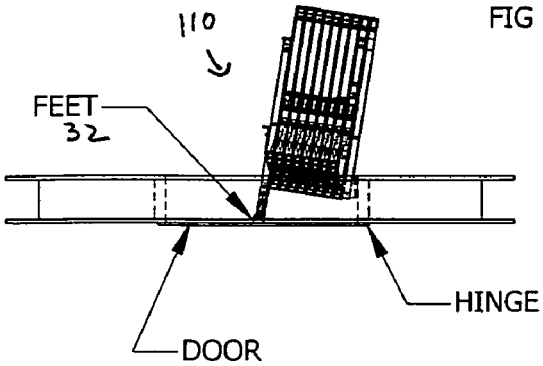
FIG. 22A shows a right side view of the ladder mounted in a section of ceiling.

FIG. 22A shows a right side view of the ladder 110 mounted in a section of ceiling. All hidden edges are shown. A door is attached to the ceiling with a hinge which enables the door to swing downward and rearward to expose the access hole 1 and the ladder 110. The door is held in the closed position as shown either by a latch or spring 47, neither of which is shown. Notice that the feet of the bottom or first section of the ladder 110 are resting on the door and that the strength of the latch or the force of the door spring 47 is sufficient to overcome the weight of the first ladder 110 section.

Figure 22B:
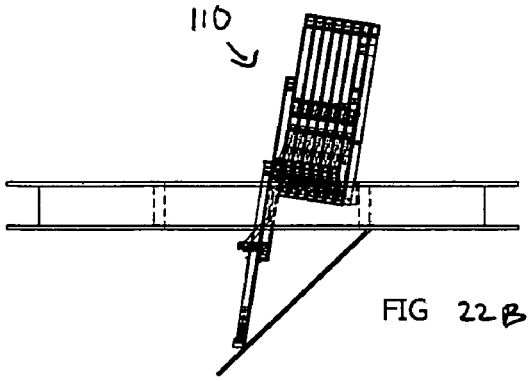
FIG. 22B shows the door partially open and the first section of the ladder fully extended.

FIG. 22B shows the door having been partially pulled open by the user and the first section of the ladder 110 fully extended and the second section of the ladder 110 extended to the point where the step stop 23 on the second section is beginning to unfold the second step on the third section. The first section will extend as shown if the step spring 47 on the first step is omitted. The second section will stop as shown because the second step resists unfolding because of its spring 47.

Figure 22C:
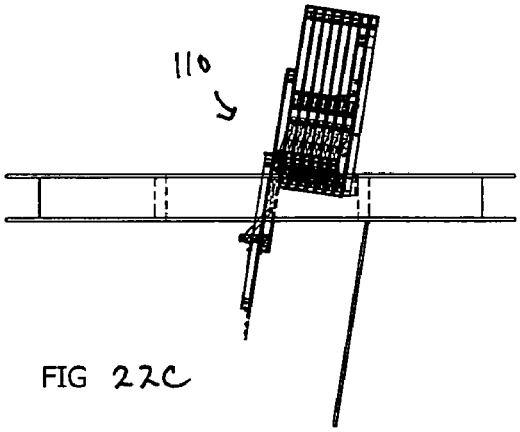
FIG. 22C shows the door fully open and the first section of the ladder fully extended.
Figure 22D:
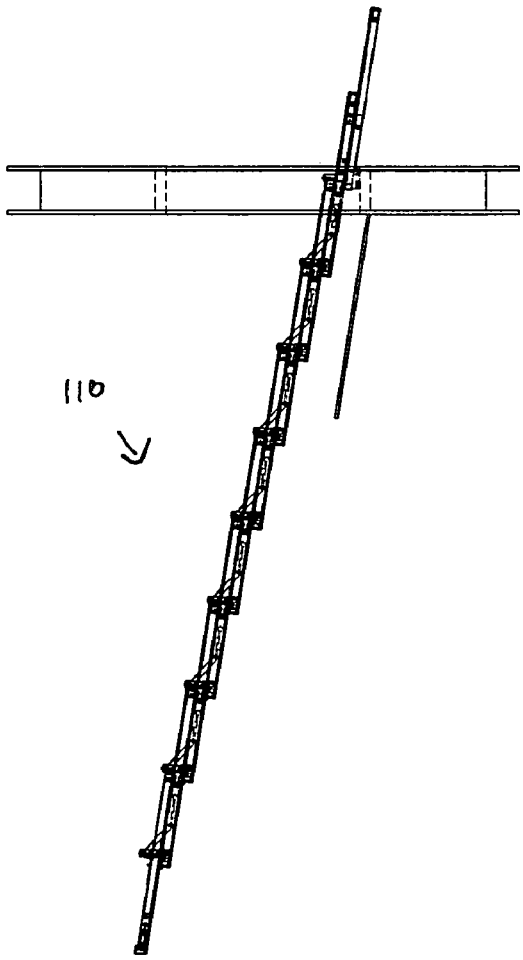
FIG. 22D shows the ladder fully extended.

FIG. 22C shows the door in its fully open position and the lowest parts of the ladder 110 within easy reach of the average person standing on the floor 3 under the access hole 1. The ladder 110 can be extended section by section by pulling down on the first section. FIG. 22D shows the ladder 110 fully extended.

To retract the ladder 110, the user would push up on the ladder 110 until it has retracted to the point shown in FIG. 22C. Then the user would swing the door forward and up to push the ladder 110 back up into the access hole 1. Once the door is closed, its latch or spring 47 will hold it shut and the ladder 110 retracted.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An access ladder for an access hole in a building comprising:

a plurality of sections which telescope relative to each other between an extended position, where the sections define a plane and a user can climb the sections, and a retracted position where the sections are folded on each other, several of the sections having at least one step which moves between an unfolded position where the user can stand on the step when the sections are in the extended position, and a folded position when the sections are in the retracted position, each section slides relative to another section of the plurality of sections which it is in contact in order for the sections to telescope, the plurality of sections include a plurality of middle sections, the plurality of sections includes a bottom section which contacts a floor when the sections are in the extended position, the middle and bottom sections have springs which contact the step to cause the step to move into the folded position as the section moves into the retracted position, each section when moving into the retracted position rises until a section is even with a section immediately behind it before being stopped, each section has opposing side rails, the middle sections and the bottom section have a step stop attached to each side rail which contacts and unfolds a folding step attached to a section immediately behind the section to which the stop step is attached as the section to which the stop step is attached moves into the extended position; and a mounting section for attachment to an end of the access hole, the plurality of sections includes a top section which slidingly connects with the mounting section.

2. A ladder as described in claim 1 wherein the side rails of the bottom, middle and top sections have at least one notch.

3. A ladder as described in claim 2 wherein when the top, middle and bottom sections are moving to the extended position, each section of the top, middle and bottom sections slide downward a distance of half its length relative to the section immediately behind it before being stopped.

4. A ladder as described in claim 3 wherein each rail of each middle section has a top cap and a bottom cap, each of the top caps slightly overlaps a rail in front of the rail to which the top cap is attached, each of the bottom caps overlaps a rail behind the rail to which the top cap is attached.

5. A ladder as described in claim 4 wherein each rail of the top and middle section has a t-rocker pivotally attached to the rail, when the sections are in the retracted position, the t-rockers protrude through a notch of a rail immediately behind the rail to which the t-rocker is mounted, when the sections are moved into the extended position, as a notch in a rail immediately in front of the rail to which the t-rocker is attached passes the t-rocker, the t-rocker pivots so the t-rocker releases the section to which the t-rocker is attached from a section immediately behind the section to which the t-rocker is attached, allowing the section to which the t-rocker is attached to be pulled down.

6. An access ladder for an access hole in a building comprising:

a plurality of sections which telescope relative to each other between an extended position, where the sections define a plane and a user can climb the sections, and a retracted position where the sections are folded on each other, several of the sections having at least one step which moves between an unfolded position where the user can stand on the step when the sections are in the extended position, and a folded position when the sections are in the retracted position, each section slides relative to another section of the plurality of sections which the section is in contact in order for the sections to telescope, the plurality of sections includes a plurality of middle sections, the plurality of sections includes a bottom section which contacts a floor when the sections are in the extended position, each section has opposing side rails, the middle sections and the bottom section have a step stop attached to each side rail which contacts and unfolds a folding step attached to the section immediately behind the section to which the step stop is attached as the section moves into the extended position; and a mounting section for attachment to an end of the access hole, the plurality of sections includes a top section which slidingly connects with the mounting section.

7. An access ladder for an access hole in a building comprising:

a plurality of sections which telescope relative to each other between an extended position, where the sections define a plane and a user can climb the sections, and a retracted position where the sections are folded on each other, several of the sections having at least one step which moves between an unfolded position where the user can stand on the step when the sections are in the extended position, and a folded position when the sections are in the retracted position, each section slides relative to another section of the plurality of sections which a section that slides is in contact in order for the sections to telescope, the plurality of sections includes a plurality of middle sections, the plurality of sections includes a bottom section which contacts a floor when the sections are in the extended position, each rail of the top and middle section has a t-rocker pivotally attached to the rail, when the sections are in the retracted position, the t-rockers protrude through a notch of a rail immediately behind the rail to which the t-rocker is mounted, when the sections are moved into the extended position, as a notch in a rail immediately in front of the rail to which the t-rocker is attached passes the t-rocker, the t-rocker pivots so the t-rocker releases the section to which the t-rocker is attached from a section immediately behind the section to which the t-rocker is attached, allowing the section to which the t-rocker is attached to be pulled down; and a mounting section for attachment to an end of the access hole, the plurality of sections includes a top section which slidingly connects with the mounting section.

* * * * *